US011440785B2

(12) United States Patent
Schultz et al.

(10) Patent No.: US 11,440,785 B2
(45) Date of Patent: Sep. 13, 2022

(54) AUTOMATED BEVERAGE DISPENSING MACHINES

(71) Applicant: Marmon Foodservice Technologies, Inc., Osseo, MN (US)

(72) Inventors: Richard Schultz, Niles, IL (US); David Joyce, Addison, IL (US); James A. Kasallis, Lombard, IL (US); Matt Dacanay, Lombard, IL (US); Milos Brablec, Arlington Heights, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 16/871,460

(22) Filed: May 11, 2020

(65) Prior Publication Data

US 2020/0270115 A1 Aug. 27, 2020

Related U.S. Application Data

(63) Continuation of application No. 16/002,491, filed on Jun. 7, 2018, now Pat. No. 10,689,240.

(60) Provisional application No. 62/516,356, filed on Jun. 7, 2017.

(51) Int. Cl.

| | |
|---|---|
| ***B67D 1/00*** | (2006.01) |
| ***B67D 1/08*** | (2006.01) |
| ***B67D 1/12*** | (2006.01) |

(52) U.S. Cl.

CPC ..... *B67D 1/0041* (2013.01); *B67D 1/0892* (2013.01); *B67D 1/1234* (2013.01); *B67D 2210/00076* (2013.01); *B67D 2210/00078* (2013.01)

(58) Field of Classification Search

CPC . A47J 37/1228; B67D 1/0041; B67D 1/0892; B67D 1/1234; B67D 2210/00076; B67D 2210/00078; G07F 13/10

See application file for complete search history.

(56) References Cited

U.S. PATENT DOCUMENTS

| | | | | |
|---|---|---|---|---|
| 3,364,959 | A * | 1/1968 | Hamilton | B67D 1/1238 141/155 |
| 4,807,780 | A | 2/1989 | Parsons et al. | |
| 4,949,526 | A | 8/1990 | Brogna et al. | |
| 4,951,719 | A | 8/1990 | Wiley et al. | |
| 5,000,345 | A * | 3/1991 | Brogna | B67D 1/00 141/103 |
| 5,044,517 | A | 9/1991 | Park | |
| 5,491,333 | A * | 2/1996 | Skell | B67D 1/1236 250/222.1 |

(Continued)

*Primary Examiner* — Gene O Crawford
*Assistant Examiner* — Kelvin L Randall, Jr.
(74) *Attorney, Agent, or Firm* — Andrus Intellectual Property Law, LLP

(57) ABSTRACT

A beverage dispensing machine includes a countertop for a conveyor that carries a plurality of cup holders around a track. A front side of the beverage dispenser machine is accessible by an operator to remove cups from the plurality of cup holders. A cup tower has a plurality of cup dispenser tubes that are each configured to hold a respective stack of cups. A cup grabber is movable up and down into and between a raised position in which the cup grabber is positioned to grab a cup from one of the stacks of cups and place a cup into one of the plurality of cup holders.

14 Claims, 31 Drawing Sheets

(56) References Cited

U.S. PATENT DOCUMENTS 5,573,041 A * 11/1996 Skell ..... B67D 1/124 141/1
5,799,932 A 9/1998 Blatt
6,053,359 A * 4/2000 Goulet ..... B65G 1/133 221/221
6,102,246 A 8/2000 Goulet et al.
6,321,904 B1 * 11/2001 Mitchell ..... B65G 15/42 198/690.2
6,409,411 B1 6/2002 Crorey
RE41,223 E 4/2010 Dellach
8,104,810 B2 1/2012 Holcomb et al.
8,162,176 B2 4/2012 Rudick
8,167,346 B2 5/2012 Filipiak
8,251,258 B2 8/2012 Rudick et al.
8,297,673 B2 10/2012 Waldorf et al.
8,340,815 B2 12/2012 Peters et al.
8,434,642 B2 5/2013 Rudick
8,454,069 B2 6/2013 Jenkins et al.
8,565,916 B2 10/2013 Zhang et al.
8,678,239 B2 3/2014 Abdelmoteleb et al.
8,739,840 B2 6/2014 Mattos, Jr. et al.
8,744,618 B2 6/2014 Peters et al.
8,751,037 B2 6/2014 Peters et al.
8,755,932 B2 6/2014 Peters et al.
8,757,222 B2 6/2014 Rudick et al.
8,814,000 B2 8/2014 Rudick
8,851,329 B2 10/2014 Rudick et al.
8,919,844 B1 12/2014 Mascorro et al.
9,017,485 B2 4/2015 Murthy et al.
9,045,323 B2 6/2015 Crane et al.
9,051,162 B2 6/2015 Peters et al.
9,067,775 B2 6/2015 Mattos, Jr. et al.
9,141,562 B2 9/2015 Pickett et al.
9,150,366 B2 10/2015 Rudick et al.
9,204,734 B2 12/2015 Jablonski et al.
9,227,830 B2 1/2016 Angus et al.
9,327,958 B2 5/2016 Angus et al.
10,232,483 B2 * 3/2019 Ohno ..... G01S 17/04
10,239,742 B2 3/2019 Dresser et al.
2009/0014464 A1 1/2009 Abdelmoteleb et al.
2012/0091162 A1 * 4/2012 Overhultz ..... A47F 1/126 221/1
2013/0075426 A1 * 3/2013 Crane ..... B67D 1/0894 222/129
2013/0079926 A1 3/2013 Peters et al.
2013/0220480 A1 8/2013 Angus et al.
2013/0282164 A1 10/2013 Veloo
2014/0001195 A1 1/2014 Patterson et al.
2014/0041748 A1 2/2014 Angus et al.
2014/0130891 A1 5/2014 Abdelmoteleb et al.
2014/0142749 A1 5/2014 Peters et al.
2014/0263447 A1 9/2014 Peters, Jr. et al.
2014/0288700 A1 9/2014 Peters, Jr. et al.
2014/0297026 A1 10/2014 Peters, Jr. et al.
2014/0361035 A1 12/2014 Rudick
2015/0251891 A1 * 9/2015 Peters ..... G06Q 30/0601 222/129.1
2015/0298956 A1 10/2015 Rudick et al.
2016/0083123 A1 3/2016 Angus et al.
2016/0114301 A1 * 4/2016 Jablonski ..... B01F 15/0408 426/231

* cited by examiner

AUTOMATED BEVERAGE DISPENSING MACHINES

CROSS-REFERENCE TO RELATED APPLICATION

The present application is a continuation of U.S. application Ser. No. 16/002,491, filed Jun. 7, 2018, which claims the benefit of U.S. Provisional Application Ser. No. 62/516,356, filed Jun. 7, 2017, both of which applications are hereby incorporated by reference in their entirety.

FIELD

The present disclosure relates to beverage dispensing machines, and particularly to automated beverage dispensing machines for automatically selecting, placing and dispensing a beverage to a cup.

BACKGROUND

The following U.S. Patents are incorporated herein by reference:

U.S. Pat. Nos. 6,102,246 and 6,053,359 disclose an automated system for preparing and delivering post-mix beverages in response to one or more drink orders being entered from a remote point of sale unit or a local keypad and including: a post-mix beverage preparation assembly for dispensing ice and a selected post-mix beverage into a cup; an oblong carousel type conveyor assembly including a plurality of upwardly open cup holders which are driven by a motor driven belt so as to pass beneath a cup dispensing station, an ice dispensing station, a beverage dispensing station, and a plurality of pick-up stations; a cup storage and dispenser assembly including a bi-directionally rotatable tower upon which is mounted a plurality of different sized cup supply tubes for holding a respective stack of beverage cups; and a pneumatic vertically driven cup gripper/extractor mechanism having a pair of pneumatically operated gripper arms which operate to remove a cup from a selected supply tube on the tower and place the extracted cup into an empty cup holder which is then transported past the dispensing stations and then to a pick-up station on the conveyor for manual removal by an attendant.

U.S. Pat. No. 9,045,323 discloses a process for dispensing a beverage into a cup comprising: providing a dispensing structure; providing a transportation mechanism linked with the dispensing structure; providing a staging structure linked with the transportation structure; providing a control system linked with the dispensing structure, staging structure and the transportation mechanism; providing a sensor mechanism linked with the control system, the sensor mechanism providing signals indicating the position of a cup; providing a cup identification system having an interactive display connected to the control system; picking a cup from a storage device and positioning it within a dispensing structure; dispensing ice and a beverage at separate locations within the dispensing structure; transporting the filled beverage to a staging structure; positioning the filled cup in the staging structure; and removing the filled cup from the staging structure for sale to a customer wherein the cup identification system and the display outputs visual characteristics indicating the position and characteristics of a cup at every stage of the process.

U.S. Pat. No. 9,204,734 discloses a cup storage device that includes a tube having opposing dispensing and terminal ends and inner and outer surfaces that define an inner volume. The inner volume receives cups stacked upon each other and stores them. The cup storage device includes a plurality of resilient cup restraining members disposed on the inner surface of the tube at the dispensing end. The cup restraining members extend from a mounting end proximate the inner surface of the tube to a contact end. A guide structure is positioned on the inner surface of the tube. The guide structure defines a recess. The contact ends of the plurality of cup restraining members are disposed within the recess.

U.S. Pat. No. 9,227,830 discloses an automated beverage dispenser for dispensing a beverage and ice into a cup. The automated beverage dispenser may include an ice dispensing station with an ice auger and a weight sensor, a beverage dispensing station, and a control device. The control device instructs the ice auger to fill the cup with a predetermined amount of ice and instructs the beverage dispensing station to fill the cup with a predetermined amount of the beverage in response to a weight of the cup as determined by the weight sensor.

U.S. Pat. No. 9,327,958 discloses an automated beverage dispenser for use with a number of cups. The automated beverage dispenser may include a carousel with a number of shelves, a first actuator configured to maneuver the shelves in a first direction, a second actuator positioned adjacent to the carousel, and a gripper positioned on the second actuator such that the second actuator is configured to maneuver one of the cups by the gripper in a second direction to one of the shelves of the carousel.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A beverage dispensing machine extends from top to bottom in a vertical direction, from right side to left side in a width direction that is perpendicular to the vertical direction, and from front to back in a depth direction that is perpendicular to the vertical direction and perpendicular to the width direction. The beverage dispensing machine includes a countertop that extends in the width direction and in the depth direction. A conveyor is on the countertop and carries a plurality of cup holders around a track. The conveyor has a front side oriented towards the front of the beverage dispensing machine and a back side oriented towards the back of the beverage machine. The front side is accessible by an operator to remove cups from the plurality of cup holders. A cup tower is located above the countertop in the vertical direction. The cup tower has a plurality of cup dispenser tubes that are each configured to hold a respective stack of cups. The cup tower is rotatable about a vertical cup tower axis. A cup grabber is located above the countertop and adjacent to the cup tower and between the back side of the track and the back of the beverage dispensing machine. The cup grabber is movable up and down in the vertical direction into and between a raised position in which the cup grabber is positioned to grab a cup from one of the stacks of cups, a lowered position in which the cup grabber is positioned to place a cup into one of the plurality of cup holders, and an intermediate position between the raised and lowered positions wherein the cup grabber is spaced apart from and between the cup tower and the plurality of cup holders in the vertical direction so that the cup tower is free to rotate about the cup tower axis and the conveyor is free to carry the plurality of cup holders around the track.

DETAILED DESCRIPTION OF THE DRAWINGS

Figure 1:
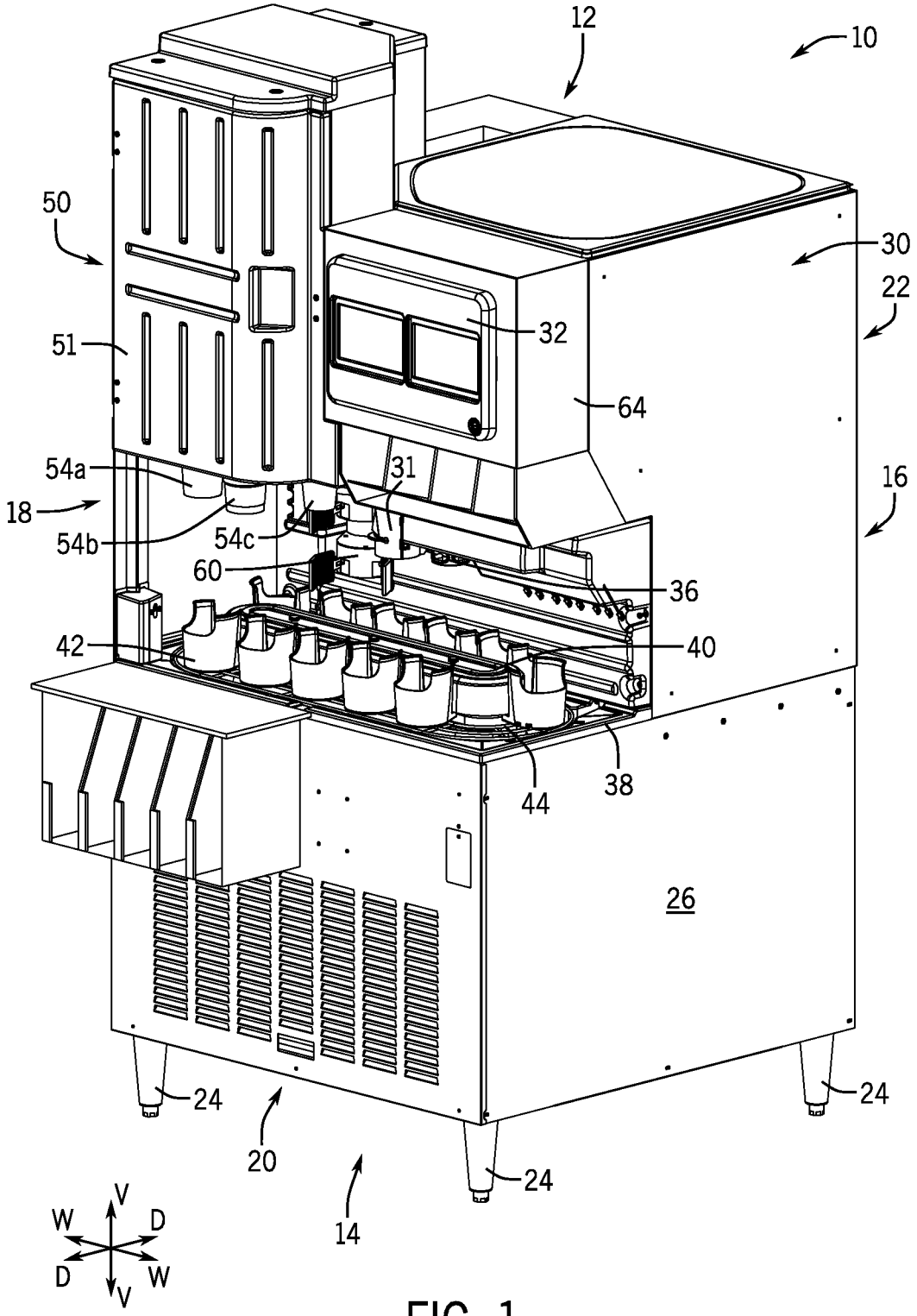
FIG. 1 is a front right side perspective view of a first embodiment of a beverage dispensing machine.

The present disclosure arose during research and development efforts to improve upon the beverage dispensing apparatuses disclosed in the above-incorporated U.S. Patents, and particularly U.S. Pat. Nos. 6,102,246 and 6,053,359.

FIGS. 1-7 depict a first embodiment of a beverage dispensing machine 10 for dispensing a post-mix beverage according to the present disclosure. The beverage dispensing machine 10 extends from top 12 to bottom 14 in a vertical direction V and from right side 16 to left side 18 in a width direction W, which is perpendicular to the vertical direction V. The beverage dispensing machine 10 further extends from a front 20 to a back 22 in the depth direction D, which is perpendicular to the vertical direction V and perpendicular to the width direction W.

The particular configuration of the beverage dispensing machine 10 can vary from that which is shown. In the illustrated example, the beverage dispensing machine 10 is supported with respect to the ground by a plurality of legs 24 and has an inner framework 25 that is covered by an outer cladding or housing 26. Generally, the beverage dispensing machine 10 includes a lower compartment 28 (FIG. 6) that houses storage space and certain refrigeration components and/or related electrical connections, as is conventional. The beverage dispensing machine 10 further includes an upper compartment 30 that houses an ice bin and associated cold plate for retaining and supplying ice to an ice chute and dispenser 31, all as is conventional. A plurality of dispensing valves 34 (FIG. 7) are located adjacent the ice bin and cold plate, above the lower compartment 28, and are configured to control flow of beverage or beverage components that are dispensed via a common dispensing nozzle 36. The type and configuration of the dispensing valves 34 and dispensing nozzle 36 can vary and for example can include the dispensing valves and dispensing nozzle disclosed in the above incorporated U.S. patents. In certain examples, interlock switches (not shown) are positioned at the ice bin lid, ice chute, and/or door 51 to thereby sense the operational state of each of these components (e.g. open or closed). Based on the state of the interlock switches the operation of the beverage dispensing machine 10 can be stopped. For example, if an interlock switch is open indicating that the door 51 is ajar, the beverage dispensing machine 10 does not operate.

Figure 3:
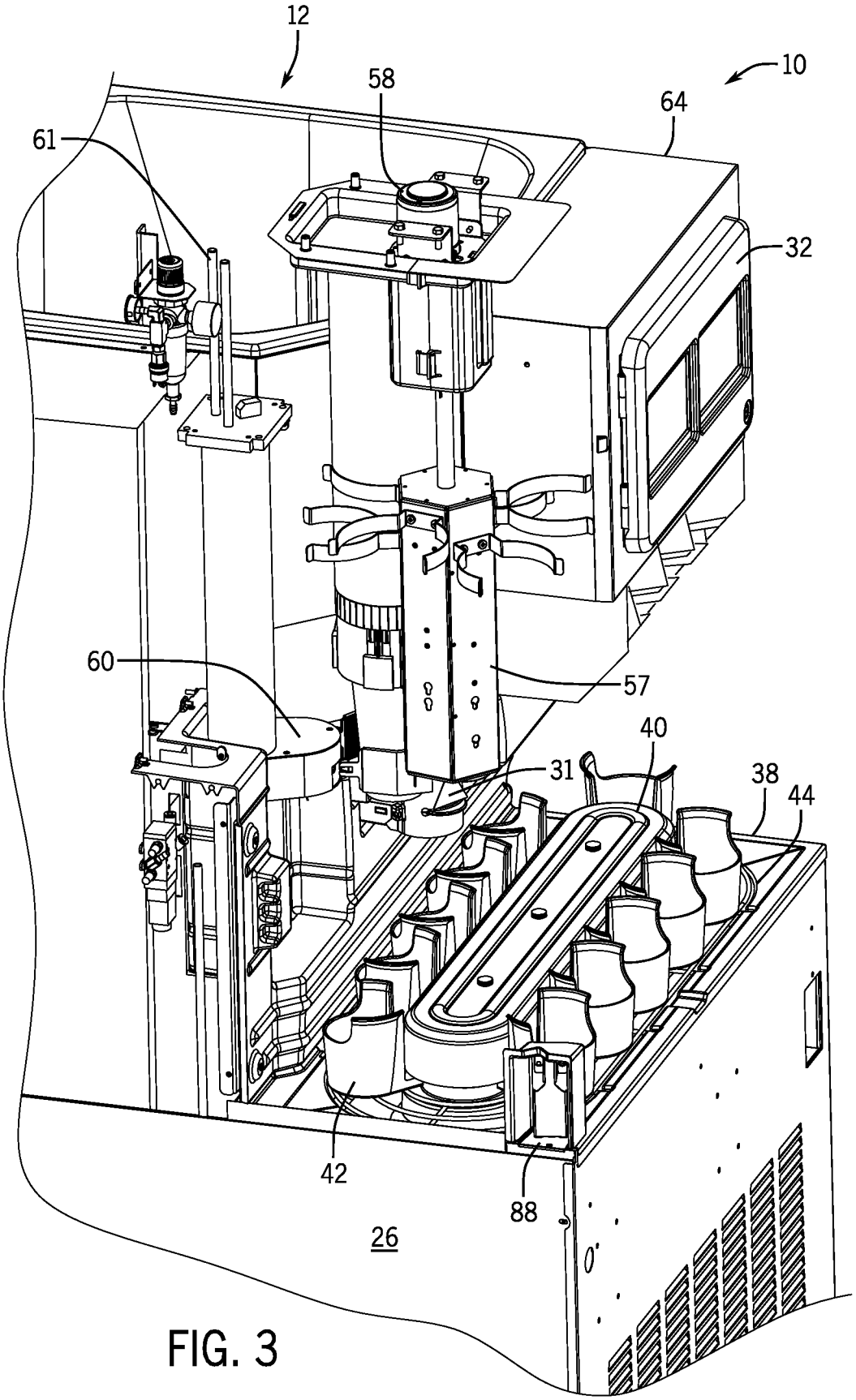
FIG. 3 is a front left side perspective view looking down on the beverage dispensing machine shown in FIG. 1.

The beverage dispensing machine 10 includes a countertop 38 located above the lower compartment 28 and below the ice chute and dispenser 31 and dispensing nozzle 36. The countertop 38 extends in the width direction W and the depth direction D. A conveyor 40 is located on the countertop 38 and is configured to carry a plurality of cup holders 42 around an oblong track 44 having a front side oriented towards the front 20 of the beverage dispensing machine 10 and a back side oriented towards the back 22 of the beverage dispensing machine 10. The front side is easily accessible by an operator so that the operator can manually remove cups from the plurality of cup holders 42, as will be described further herein below. Referring to FIG. 3, a bi-directional electric motor 33 (FIG. 6) is connected to the conveyor 40 and configured to move the conveyor 40 around the track 44, similar to the embodiments described in the above-incorporated U.S. Pat. Nos. 6,102,246 and 6,053,359.

A cup tower 50 is located above the countertop 38. The cup tower 50 is located between the back side of the track 44 and the back 22 of the beverage dispensing machine 10 with respect to the depth direction D. The cup tower 50 includes a plurality of cup dispenser tubes 52, which in this example are elongated tubes that are configured to hold respective stacks of cups 54*a*, 54*b*, 54*c*, etc. Each tube 52 can have a retaining structure for temporarily holding the stacks of cups, as is disclosed in the above-incorporated U.S. Pat. No. 9,204,734. The cup tower 50 is rotatable about a vertical cup tower axis via a center mandrel 57 (FIG. 3) and a cup tower motor 58. The cup tower motor 58 can be an electric motor that is configured to rotate the cup tower 50 about the cup tower axis. The cup tower motor 58 is advantageously located above the cup tower 50 in the vertical direction V, apart from any beverage that happens to spill on the countertop 38. A door 51 encloses the stacks of cups 54 within the cup tower 50

A cup grabber 60 is located above the countertop 38 and adjacent the cup tower 50 and between the back side of the track 44 and the back 22 of the beverage dispensing machine 10. The cup grabber 60 is located between the cup tower 50 and the dispensing nozzle 36. The cup grabber 60 is movable up and down in the vertical direction V into and between a raised position in which the cup grabber 60 is positioned to grab a cup 54 from one of the stacks of cups, a lowered position in which the cup grabber 60 is positioned to place a cup into one of the plurality of cup holders 42, and an intermediate position in between the raised and lowered positions wherein the cup grabber 60 is spaced apart from and between the cup tower 50 and the plurality of cup holders 42 in the vertical direction V so that the cup tower 50 is free to rotate about the cup tower axis and the conveyor 40 is free to carry the plurality of cup holders 42 around the track 44. A pneumatic actuator is configured to move the cup grabber 60 up and down along a cup grabber center shaft 61, into and between the noted lowered, raised, and intermediate positions. Advantageously, the cup grabber motor is located vertically above the cup grabber 60, apart from any beverage that happens to spill on the countertop 38. As described in the above-incorporated U.S. Pat. Nos. 6,102,246 and 6,053,359, the cup grabber 60 has a pair of grabber arms that are configured to open and close with respect to each other to grab a cup from the cup tower 50 and then place the cup into the particular cup holder 42 located below the cup grabber 60.

A computer controller 64 has a processor and a memory and is configured to control the conveyor 40 by controlling operation of the conveyor motor 33, control rotation of the cup tower 50 about the cup tower axis by controlling operation of the cup tower motor 58, and control the cup grabber 60 into and between the noted lowered, raised, and intermediate positions by controlling operation of the pneumatic actuator. A user interface 32 is disposed on the front 20 of the beverage dispensing machine 10, adjacent the noted ice bin and above the lower compartment 30. The user interface 32 can include one or more touch screens and/or push buttons and/or switches and/or dials and/or the like for accepting operator inputs. The user interface 32 is configured to electrically communicate operator inputs to the computer controller 64, which in turn controls the noted conveyor motor 33, cup tower motor 58, and cup grabber motor based upon the inputs. The controller 64 is further programed and configured to control the plurality of dispensing valves 34 to dispense a particular post-mix beverage to the dispensing nozzle 36, based upon the operator inputs via the user interface 32, all as is conventional.

Figure 8:
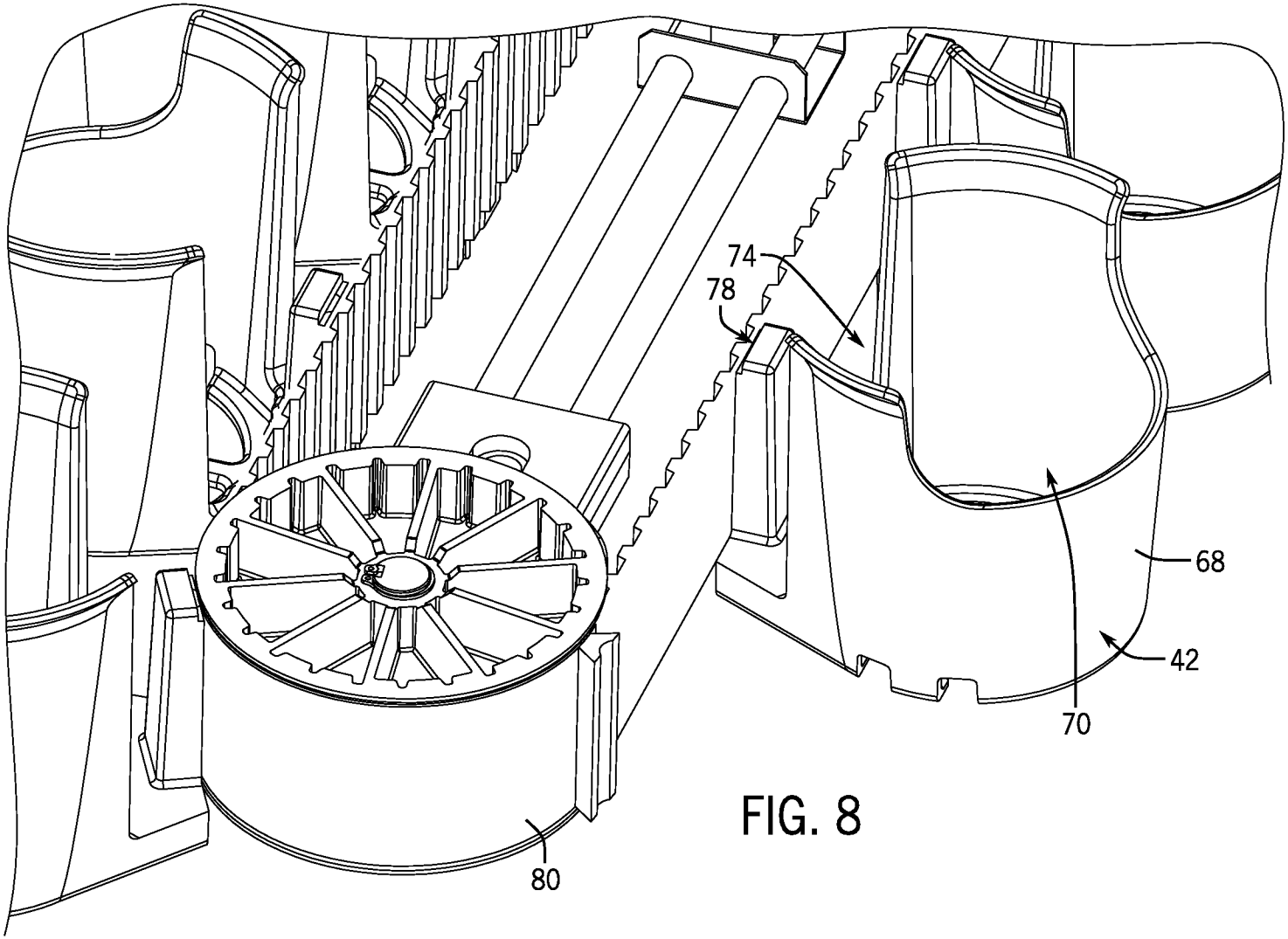
FIG. 8 is a detailed view of the connection between a cup holder and a conveyor belt and showing one cup holder removed from the belt.
Figure 9:
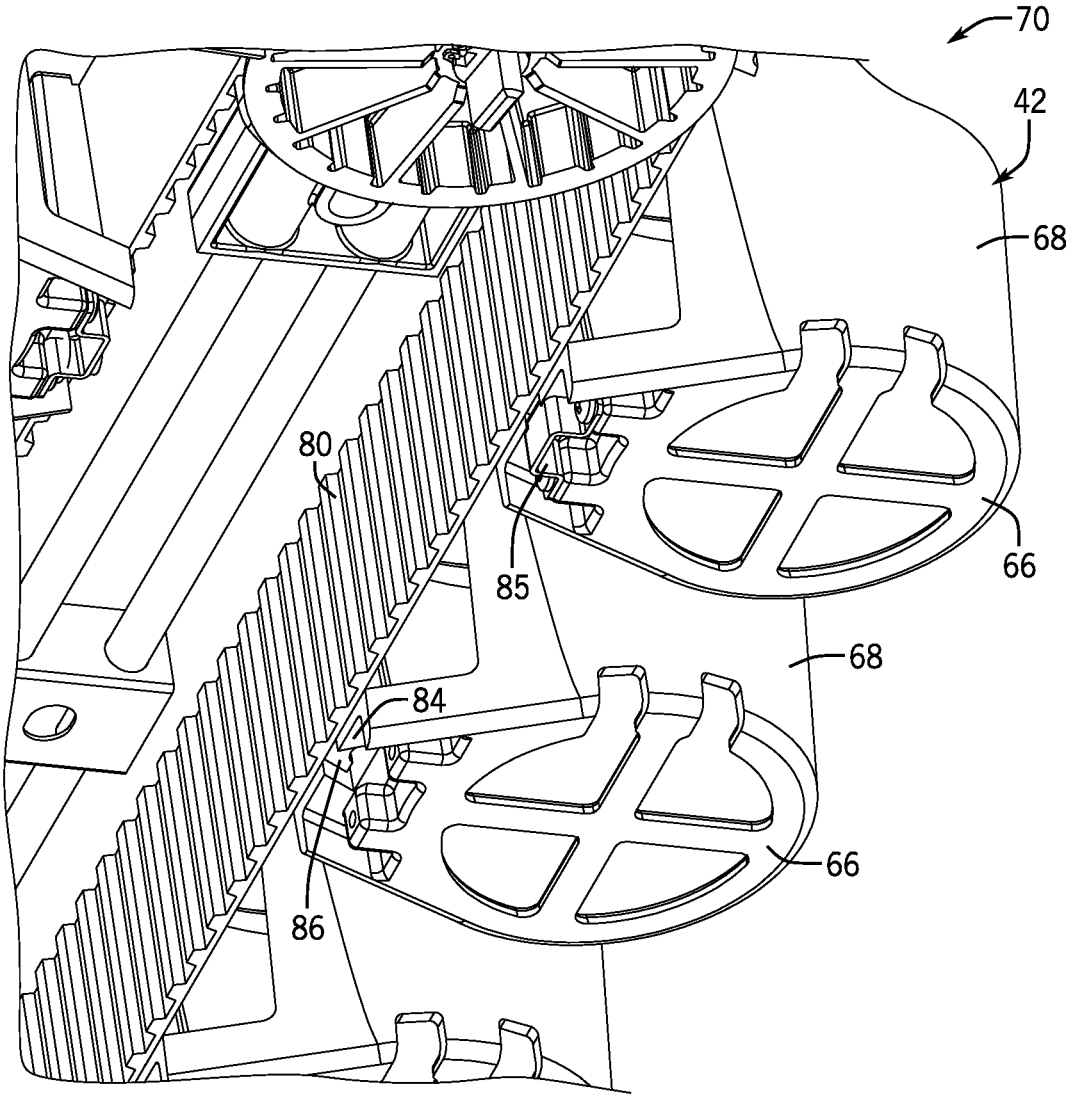
FIG. 9 is another detailed view of the connection.

Referring to FIGS. 8 and 9, each cup holder 42 includes a base 66, sidewalls 68 which extend upwardly from the base 66 and a front window 70 defined by the sidewalls 68 and having an open top. The front window 70 is oriented away from the center of the track 44 and is sized to facilitate manual grasping and removal of a cup 54 from the cup holder 42 when the cup holder 42 is located on the front side of the track 44. Each cup holder 42 further includes a rear window 74 oriented towards the center of the track. The rear window 74 has an open top and facilitates manual access to a dovetail connection 78 between the cup holder 42 and the conveyor 40. The rear window 74 is located directly opposite (i.e. diametrically opposite) the front window 70 so that the sidewalls 68 form a pair of side flanges on opposite sides of the cup. The conveyor 40 includes a conveyor belt 80 that extends around the track 44. The conveyor belt 80 is driven by the conveyor motor 33. Each cup holder 42 is connected to the conveyor belt 80 by the dovetail connection 78. Each dovetail connection 78 includes a vertical dovetail channel 84 and vertical dovetail tab 86 that is received in the dovetail channel 84 by manually sliding one of the dovetail channel 84 and dovetail tab 86 with respect to the other. A bracket 85 is attached to retain the dovetail connection in place.

Figure 2:
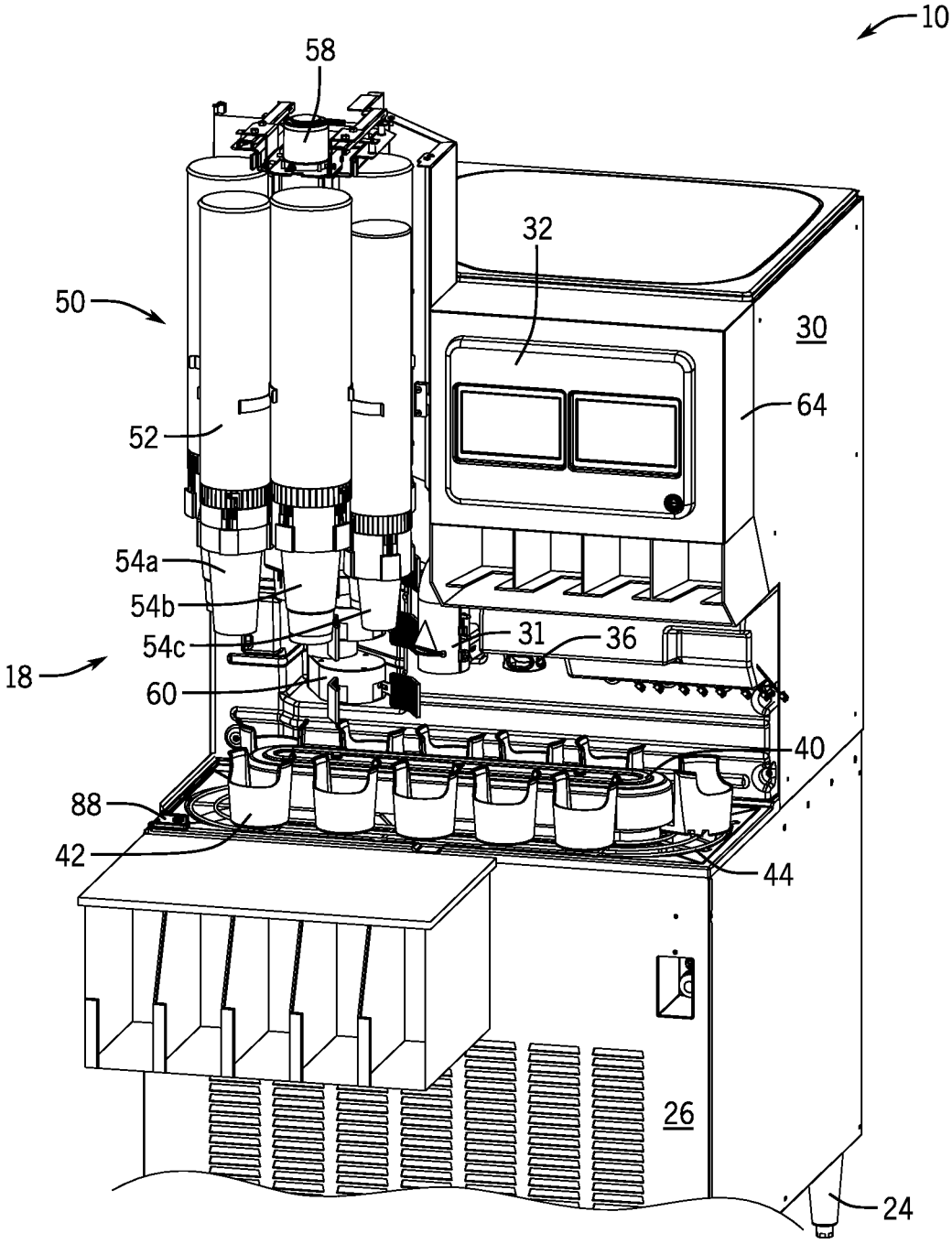
FIG. 2 is another front right side perspective view of the beverage dispensing machine shown in FIG. 1.
Figure 4:
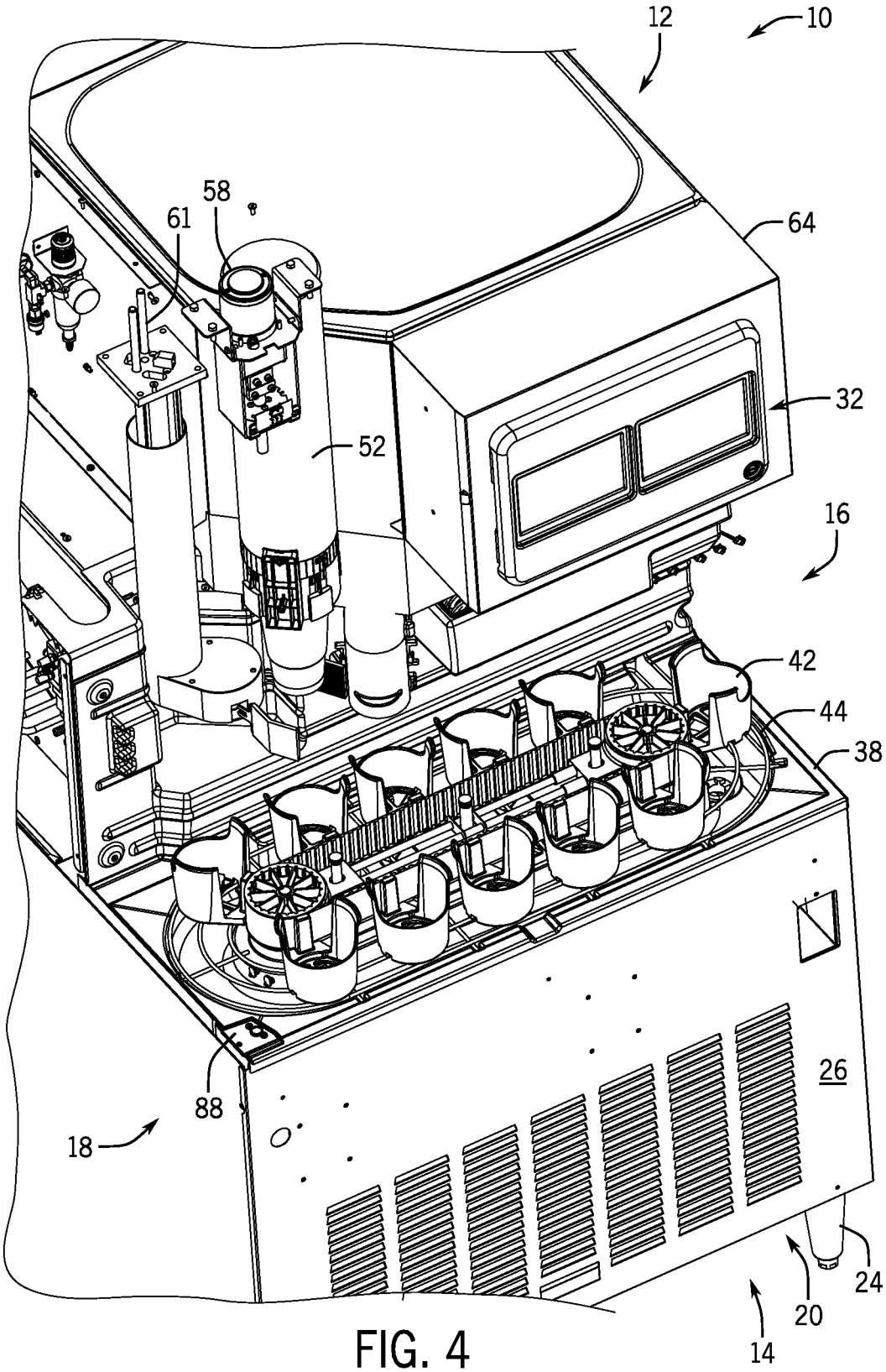
FIG. 4 is a front left side perspective view of the beverage dispensing machine shown in FIG. 1, having a cover on the conveyor removed.
Figure 5:
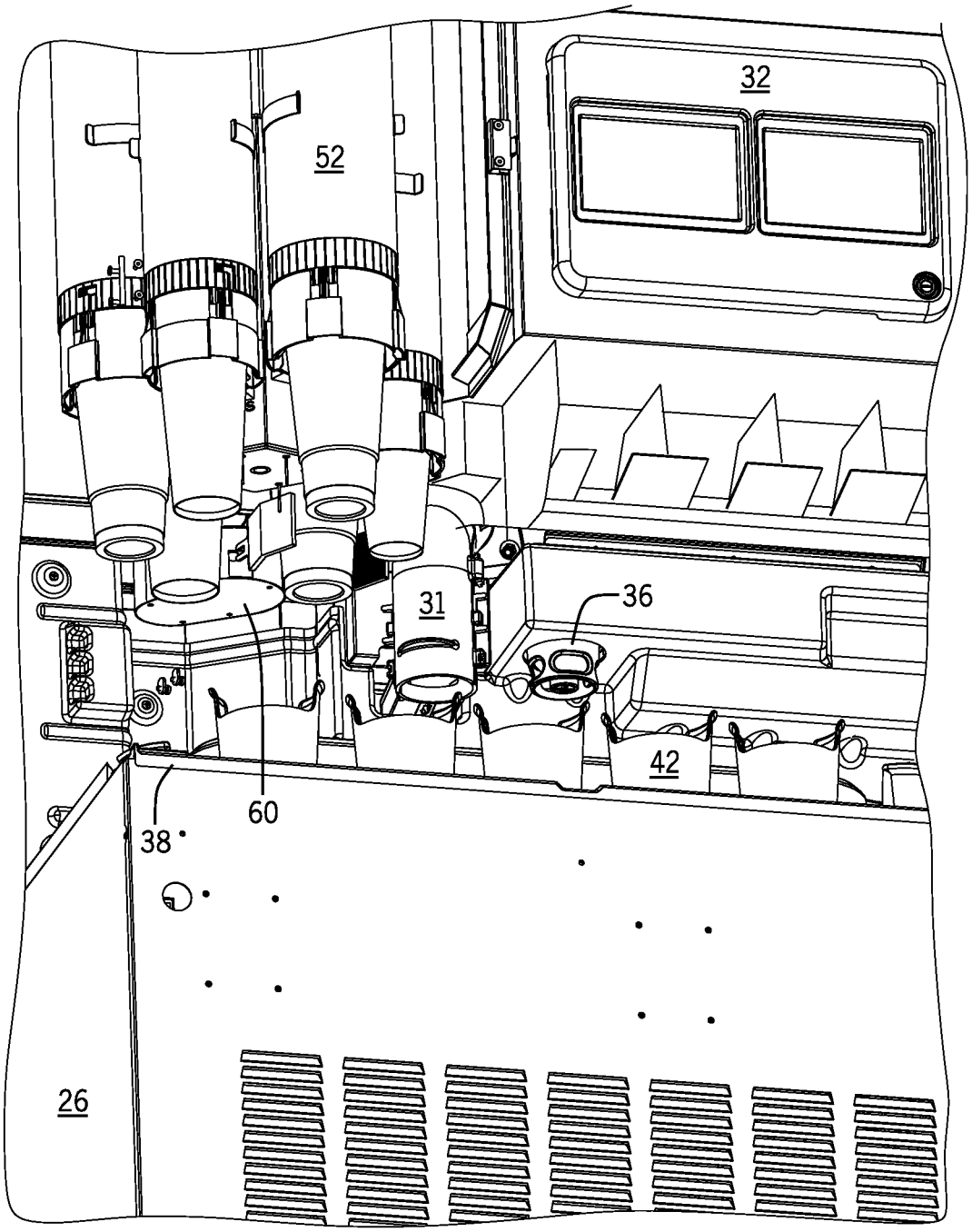
FIG. 5 is a front left side perspective view looking up at the beverage dispensing machine shown in FIG. 1.

Referring to FIGS. 2-4, an ultrasonic sensor 88 is located between the front 20 of the beverage dispensing machine 10 and the track 44. The ultrasonic sensor 88 is configured to sense whether a cup 54 is present in the cup holders 42. Specifically, the ultrasonic sensor 88 is configured to sense the presence of a cup 54 via the noted front window 70 in the cup holder 42. The controller 64 is in communication with the ultrasonic sensor 88 and is configured to control the conveyor 40, in part, based upon an output from the ultrasonic sensor 88. As shown in FIG. 4, the ultrasonic sensor 88 is spaced apart from the track 44 so that a gap exists between the ultrasonic sensor 88 and the track 44. The ultrasonic sensor 88 is configured to repeatedly emit ultrasonic waves to thereby sense whether a cup 54 is present in the respective cup holders 42. The ultrasonic sensor 88 is configured to sense in succession in order to rule out a false reading caused by a temporary obstruction, such as an operator's hand, located in the gap between the ultrasonic sensor 88 and the track 44. In certain examples, the ultrasonic sensor 88 could instead be an optical sensor or any type of proximity sensor.

Figure 10:
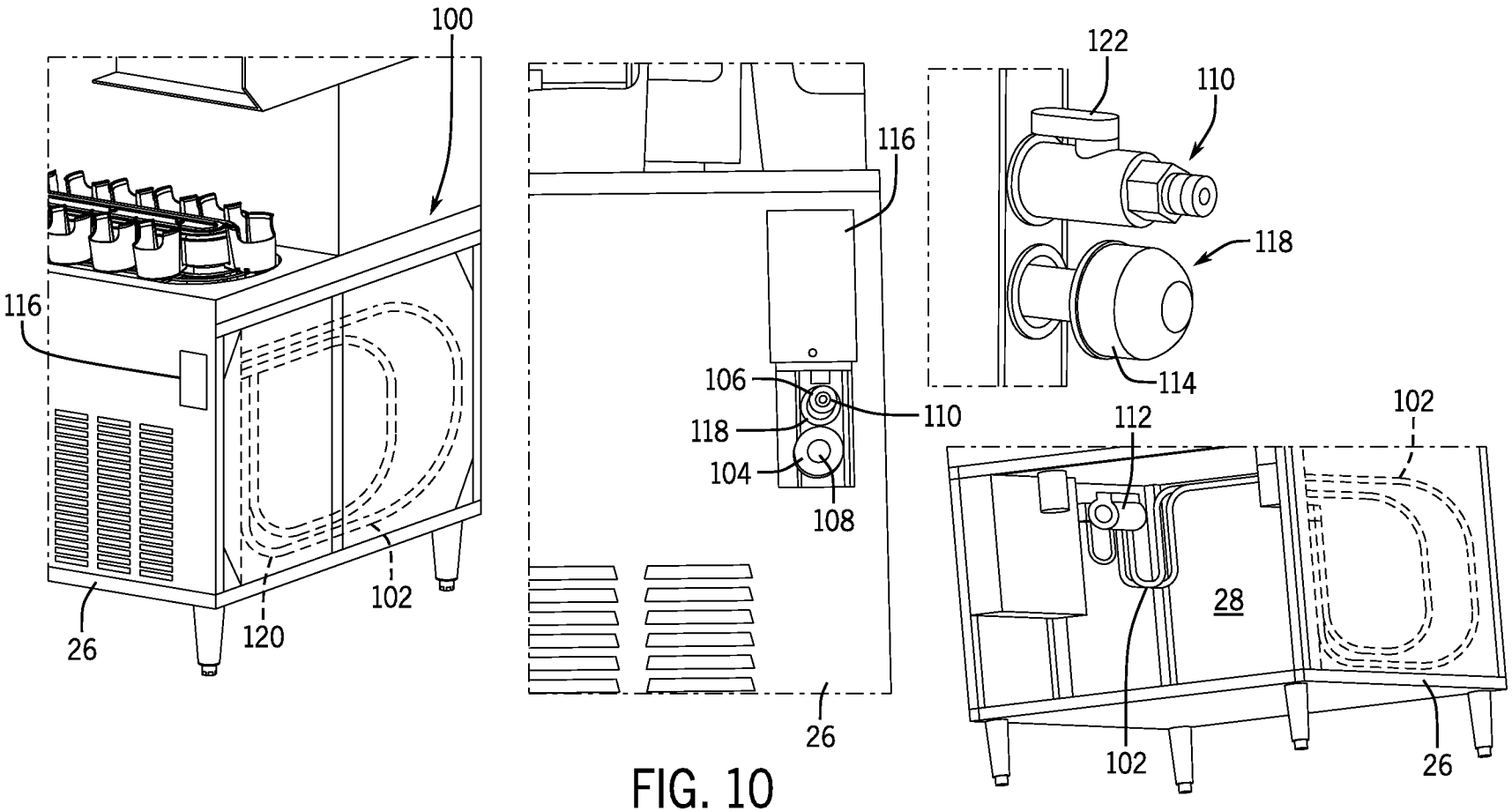
FIG. 10 depicts a clean in place system for the beverage dispensing machine shown in FIG. 1.
Figure 11:
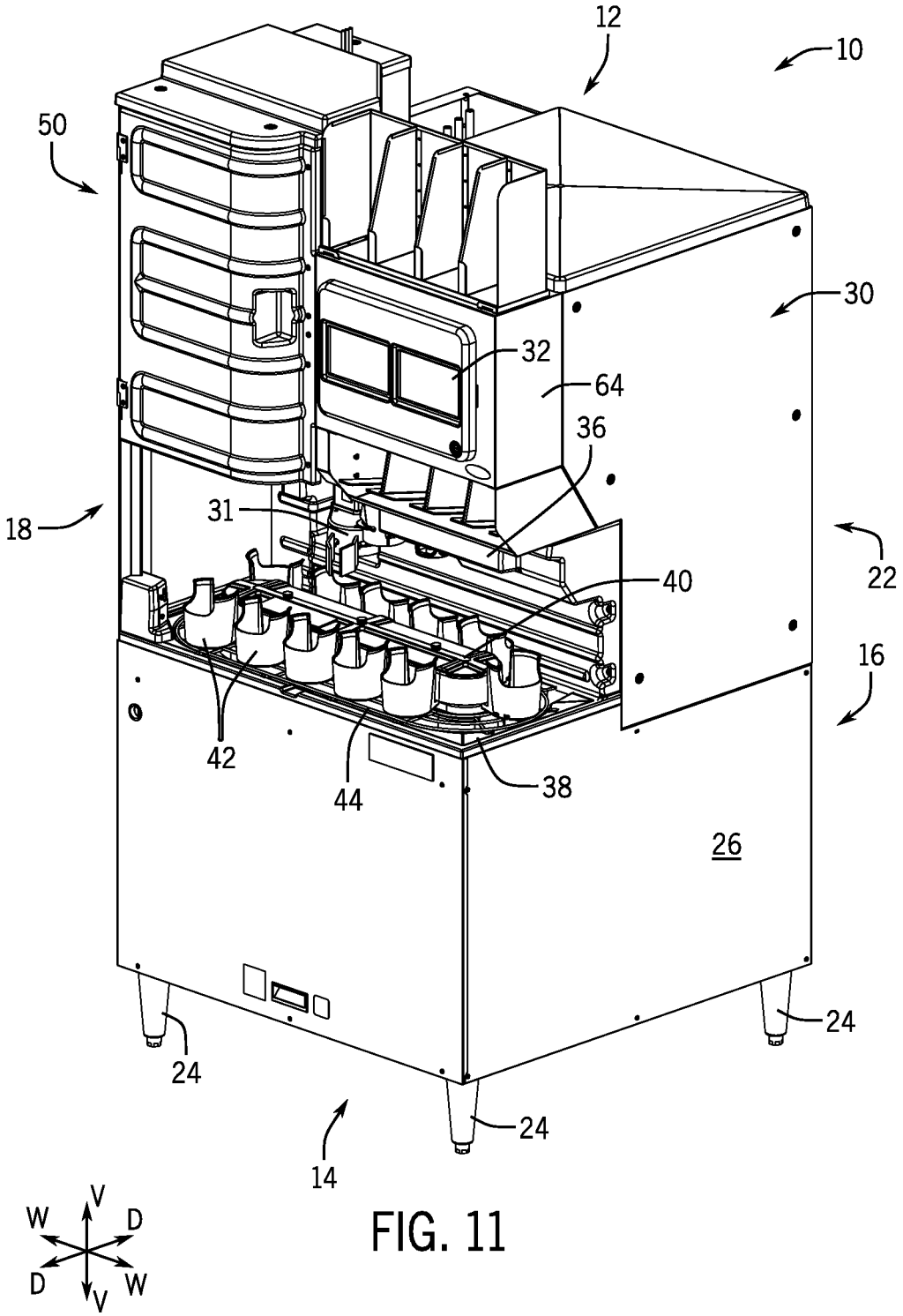
FIG. 11 is a front right side perspective view of another embodiment of the beverage dispensing machine
Figure 12:
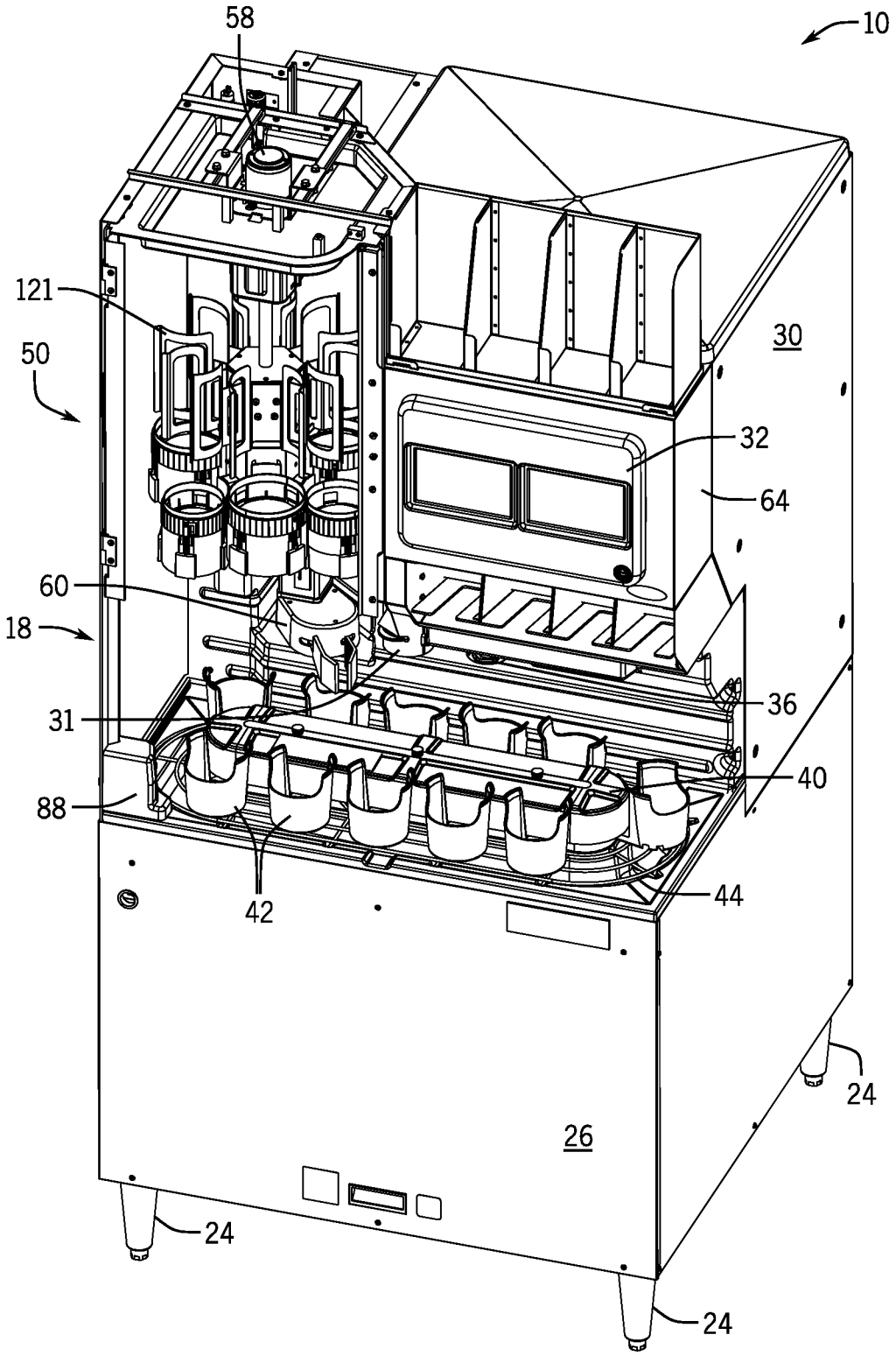
FIG. 12 is another front right side perspective view of the beverage dispensing machine shown in FIG. 11.
Figure 13:
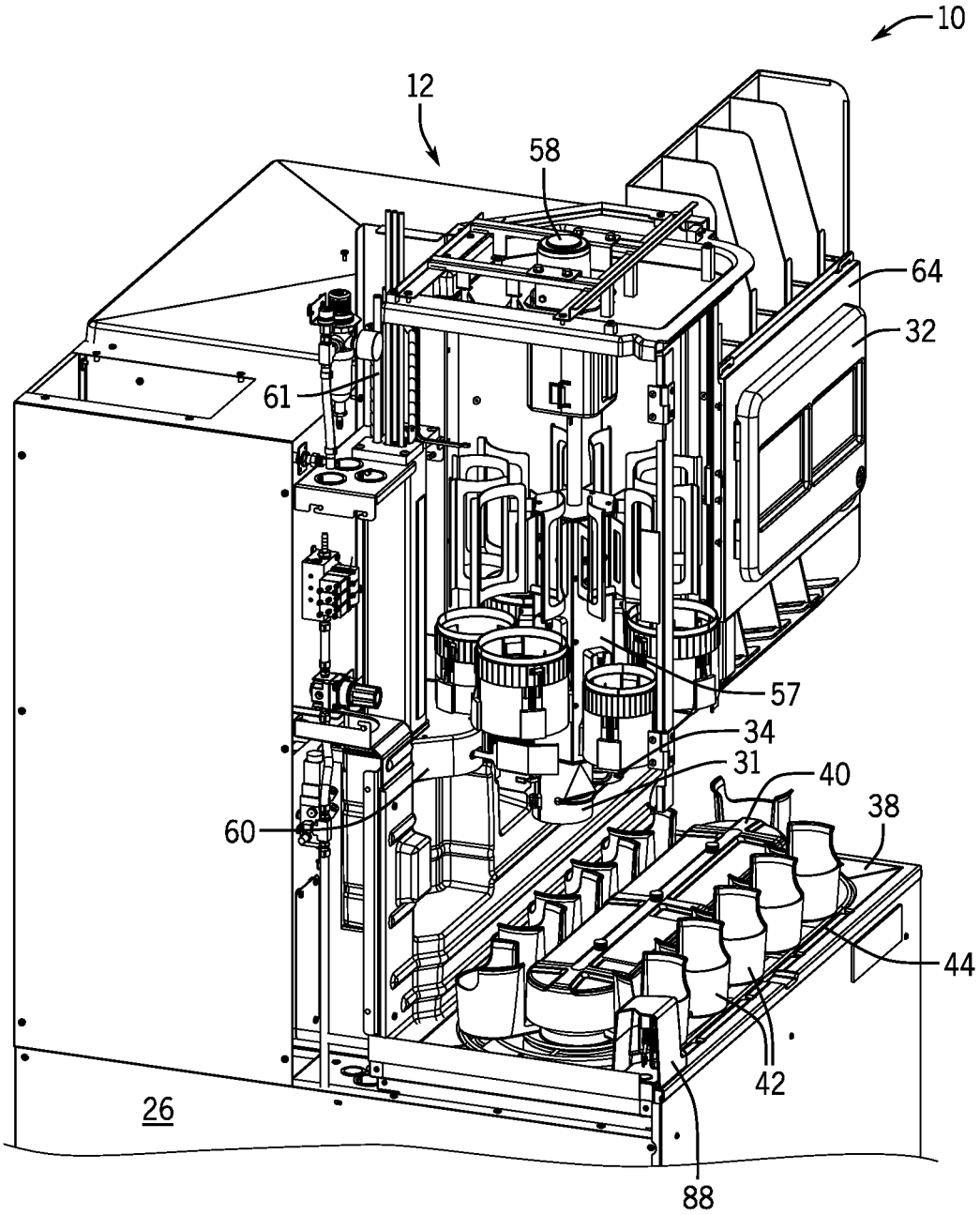
FIG. 13 is a front left side perspective view looking down on the beverage dispensing machine shown in FIG. 11.
Figure 14:
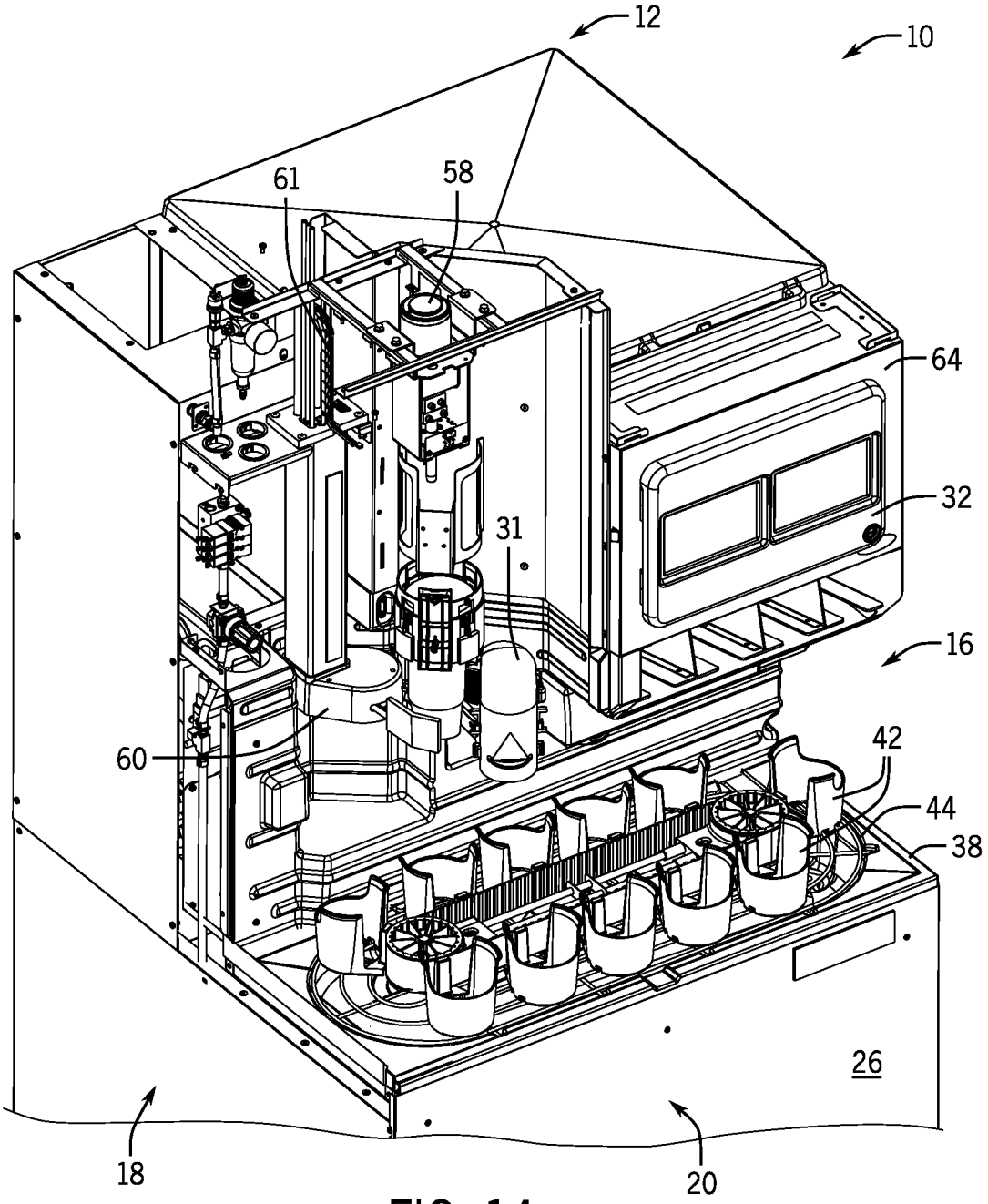
FIG. 14 is a front left side perspective view of the beverage dispensing machine shown in FIG. 11, having a cover on the conveyor removed.
Figure 15:
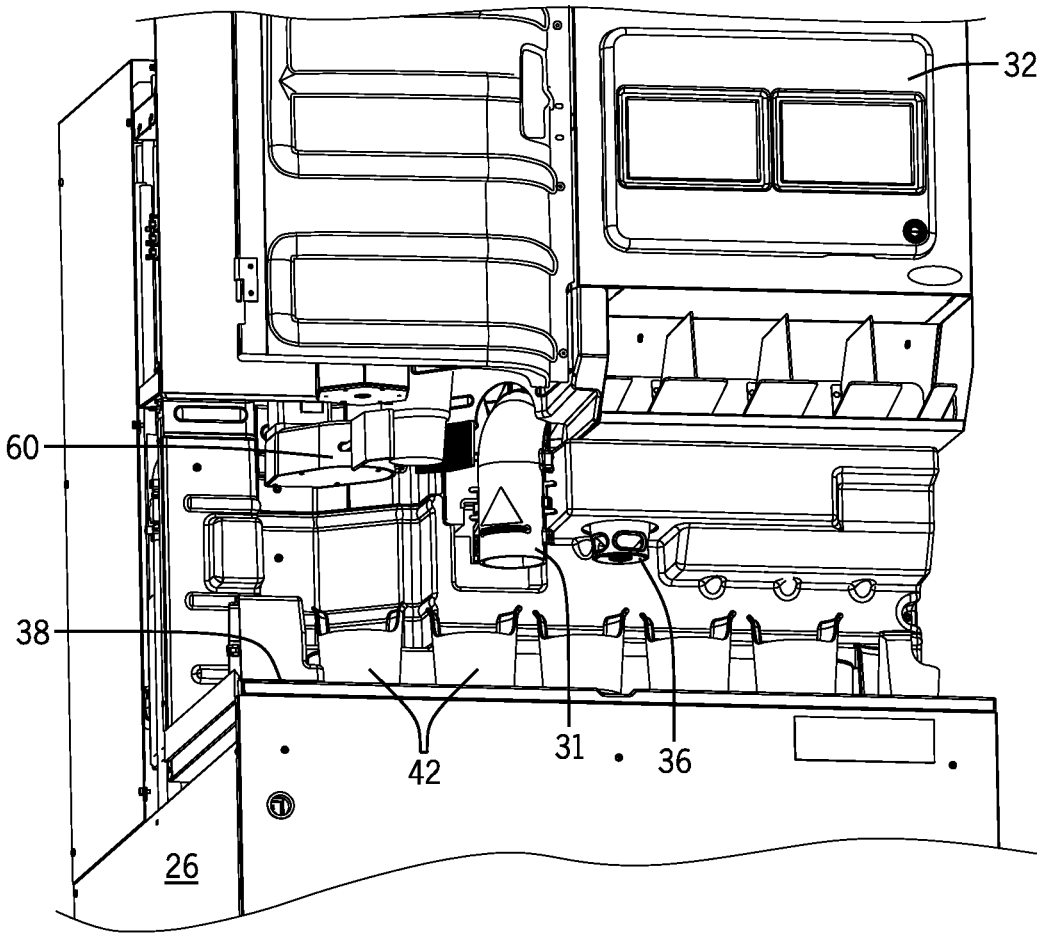
FIG. 15 is a front left side perspective view looking up at the beverage dispensing machine shown in FIG. 11.
Figure 16:
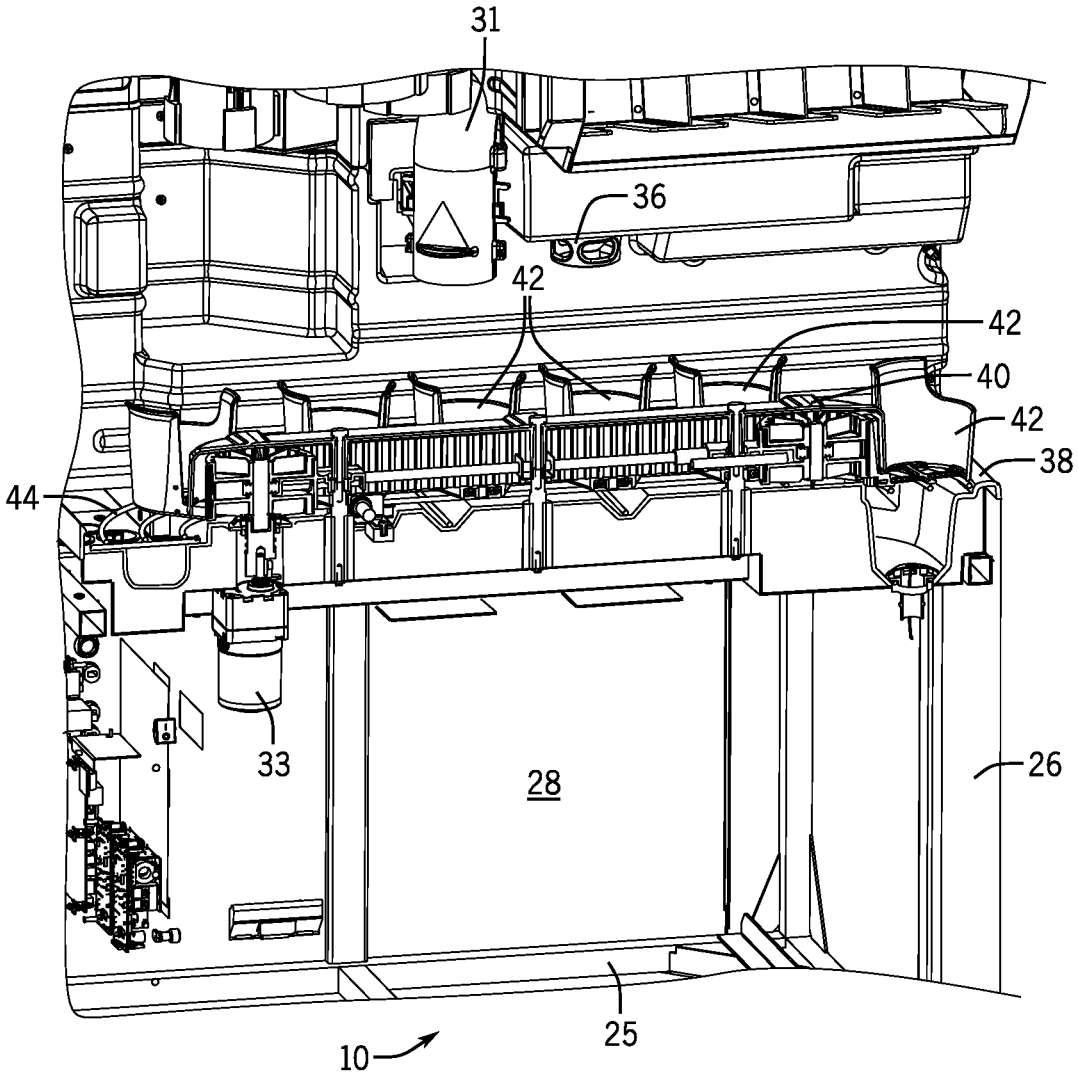
FIG. 16 is a sectional view of the beverage dispensing machine shown in FIG. 11 and showing a conveyor for conveying a plurality of cup holders around a track.
Figure 17:
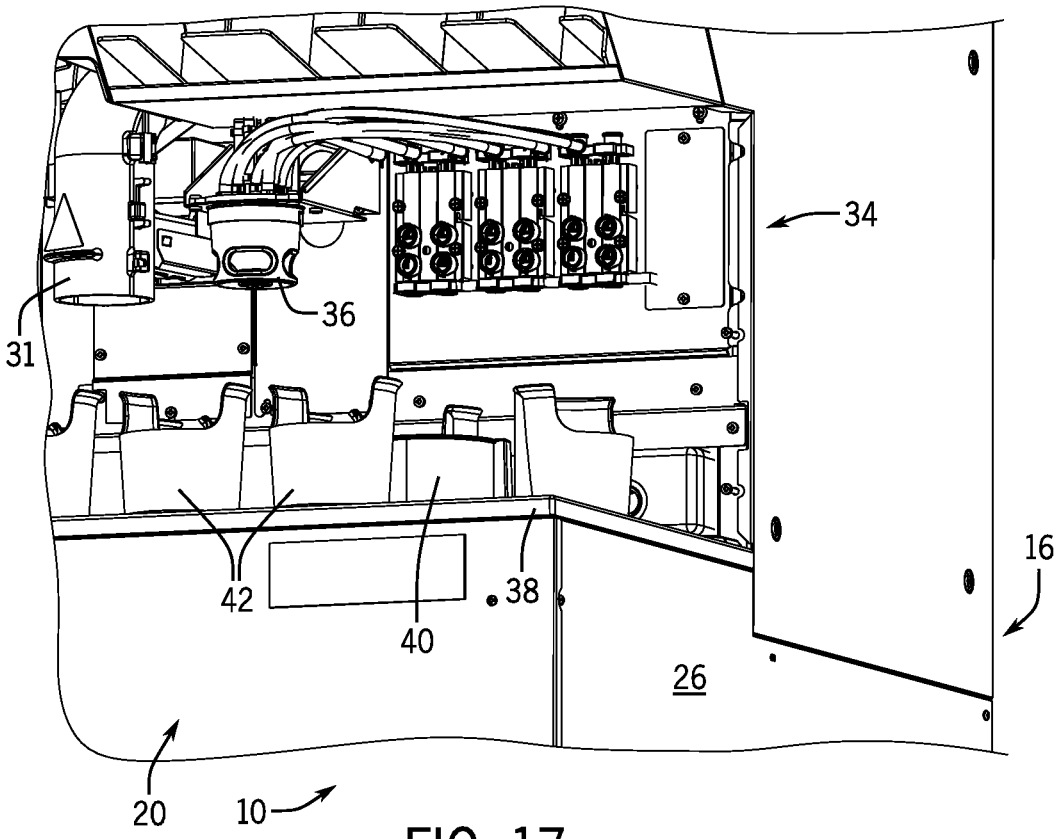
FIG. 17 is a front right side perspective view looking up at dispensing valves on the beverage dispensing machine.

Referring to FIG. 10, the beverage dispensing machine 10 has an integrated clean-in-place system 100 that is contained within the lower compartment 28 and enclosed by the housing 26. The clean-in-place system 100 includes a hose 102 having a first end 104 and a second end 106. The first end 104 has an inlet with a strainer 108 for receiving and straining a cleaning solution from, for example, a bucket or other source of cleaning solution. The second end 106 has an outlet with a nozzle 110 for dispensing, e.g. spraying, the cleaning solution for cleaning of the beverage dispensing machine 10, for example the noted ice bin. A pump 112 is disposed in the lower compartment 28 and is connected to the hose 102. The pump 112 is configured to draw cleaning solution into the first end via strainer 108 and pump the cleaning solution through the hose 102 to the nozzle 110 at the second end 106. The exact configurations of the strainer 108 and nozzle 110 can vary from that which is shown. In the illustrated example, the strainer 108 has inlet holes 114 that are radially spaced around the body of the strainer 108 to facilitate inflow of cleaning solution into the first end 104 when, for example, the body of the strainer 108 is resting at the bottom of the bucket in which the cleaning solution is contained.

The clean-in-place system 100 further includes an inlet door 116 on the housing 26. The inlet door 116 is manually positionable into and between an open position, shown in the middle view in FIG. 10 wherein the first and second ends 104, 106 of the hose 102 are manually accessible via the inlet door 116 and a closed position, shown in the left view in FIG. 10, wherein the first and second ends 104, 106 of the hose 102 are enclosed within the housing 26. When the inlet door 116 is in the open position, the first and second ends 104, 106 of the hose 102 are manually removable from the housing 26 via the inlet door 116. The hose 102 is conveniently coiled (guided) into the housing 26 via a partition wall 118 and a sidewall 120 of the housing 26. This allows for easy storage and removal of the hose 102.

Instructions for operation of the clean-in-place system 100 are provided in FIG. 10. In use, the first end 104 of the hose 102 is manually withdrawn from the housing 26 via the inlet door 116 and placed into the cleaning solution. The second end 106 is manually removed and a valve 122 on the nozzle 110 is manually operated to open a flow of cleaning solution via the nozzle 110, under force from the pump 112. The nozzle 110 can be configured to provide a 45° spray pattern of cleaning solution; however, other configurations are contemplated and are within the scope of this disclosure. In some examples, the pump 112 can be a dual diaphragm pump, which is driven by compressed air and controlled by solenoid. Other configurations are contemplated and are within the scope of this disclosure. The hose 102 can be a plastic tubing, or any other type of conduit for facilitating flow of the cleaning solution. In certain examples, the clean-in-place system 100 can be added to or retrofitted to a previously installed beverage dispensing machine 10. In certain examples, the clean-in-place system 100 will periodically activate and provide cleaning instructions to the operator via the user interface 32. The operator has the option of performing cleaning when promoted or dismiss the cleaning instructions or prompts.

FIGS. 11-17 depict a second embodiment of the beverage dispensing machine 10 for dispensing a post-mix beverage, according to the present disclosure. A person having ordinary skill in the art will recognize that the beverage dispensing machine 10 depicted in FIGS. 11-17 can include various components described herein with respect to FIGS. 1-10. The beverage dispensing machine 10 depicted in FIG. 11-17 includes a cup tower 50 with a plurality of cup dispenser clips 121 (FIG. 12) in lieu of the cup dispenser tubes 52 (FIG. 2).

Figure 18:
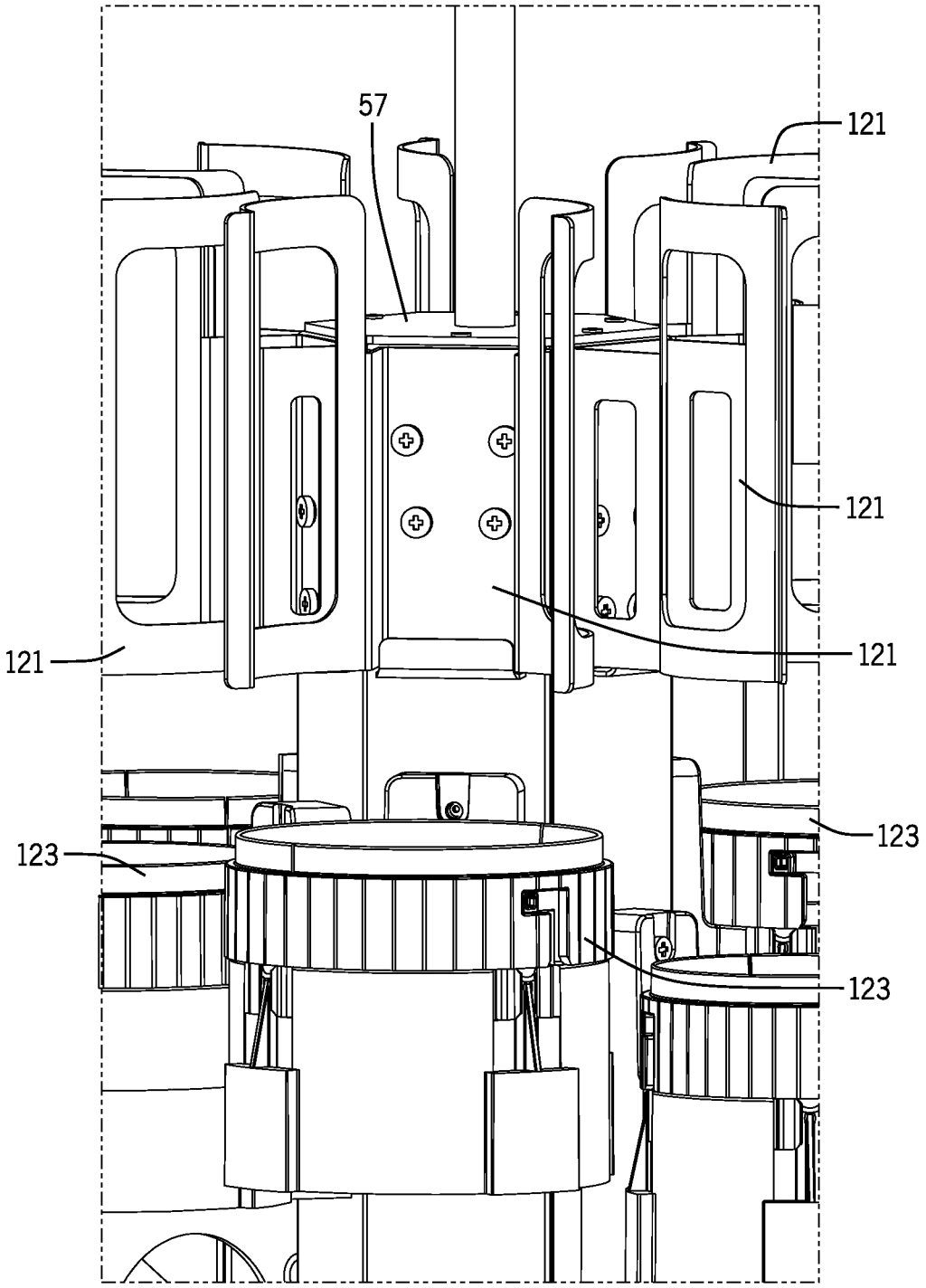
FIG. 18 is a front perspective view of an example cup tower with a plurality of cup dispenser clips.
Figure 19:
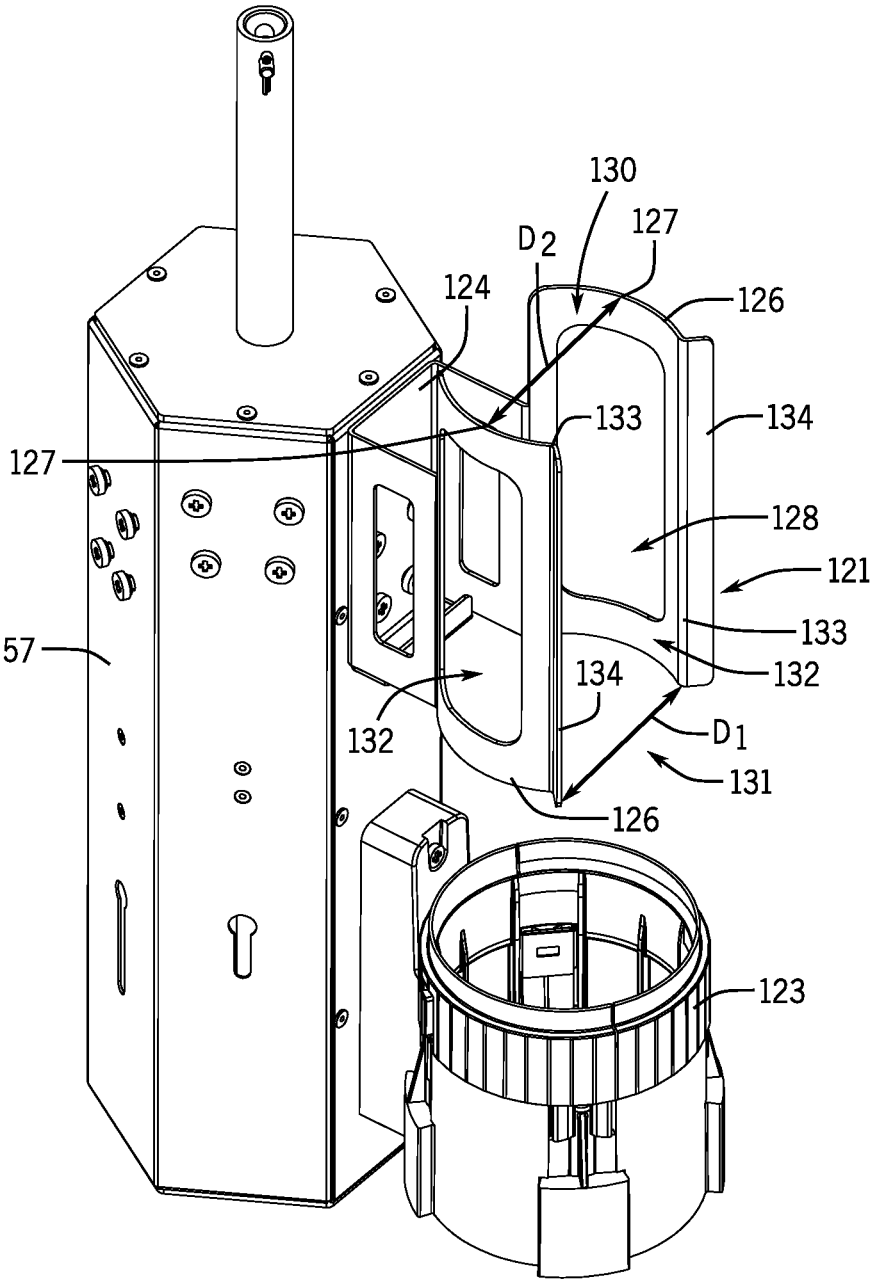
FIG. 19 is a front perspective view of an example cup tower with a cup dispenser clip.

Referring FIGS. 18-19, an example cup tower 50 with a plurality of cup dispenser clips 121 is depicted. Each cup dispenser clip 121 is configured to hold a stack of cups 54 (see stack of cups 54*a*, 54*b*, 54*c* in FIG. 1). A retaining structure 123 is positioned vertically directly below each cup dispenser clip 121 and is for temporarily holding the stacks of cups 54, as is disclosed in the above-incorporated U.S. Pat. No. 9,204,734. The cup dispenser clips 121 are coupled to the center mandrel 57 and rotate about the vertical cup tower axis as the cup tower motor 58 (FIG. 4) is actuated. The size and shape of the cup dispenser clips 121 can vary. For example, a large cup dispenser clip 121 is used to hold large cups 54 and a small cup dispenser clip 121 is used to hold small cups 54. The cup dispenser clips 121 are interchangeable such that the type and/or size of the cups 54 held in the cup dispenser clips 121 can be modified as the beverage dispensing machine 10 is operated.

Referring specifically to FIG. 19, a single dispensing clip 121 is depicted coupled to the center mandrel 57. The cup dispenser clip 121 has a planar base 124 that is mounted flush to the outer surface of the center mandrel 57, an open upper end 130, an opposite open lower end 131, and a pair of opposing arms 126 that define an interior space 128 and a side opening 132. The arms 126 are elastic or bendable and are configured to elastically deform as the stack of cups 54 are loaded into the cup dispenser clip 121. The arms 126 and/or the cup dispenser clip 121 are advantageously designed such that the stack of cups 54 (see FIG. 4) can be loaded into the interior space 128 in a variety of ways. For instance, the stack of cups 54 can be top-loaded into the interior space 128 by passing the stack of cups 54 through the open upper end 130. The stack of cups 54 can also be bottom-loaded into the interior space 128 through the open lower end 131. In some instances, the stack of cups 54 is elongated such that the stack of cups 54 cannot be easily top-loaded or bottom-loaded into the cup dispenser clip 121. Furthermore, space constraints around the beverage dispensing machine 10 or the proximity of other machines may prevent the stack of cups 54 from being top-loaded and/or bottom-loaded. Accordingly, the stack of cups 54 is side-loaded into the interior space 128 by pressing the stack of cups 54 into the arms 126 such that the arms 126 elastically deform thereby permitting the stack of cups 54 to pass into the interior space via the side opening 132. The arms 126 return to their original shape (e.g. "snap back") after the stack of cups 54 are positioned into the interior space 128.

The arms 126 are curved and each have an side edge 133. The side edges 133 define an side edge distance D1 that is less than a center distance D2 defined between centers 127 of the arm 126. The side edge distance D1 is less than the diameter of the cups 54 such that the stack of cups 54 retained by the cup dispenser clip 121 do not easily tilt through the side opening 132 and fall out of the cup dispenser clip 121. Each arm 126 has a guide member 134 that extends away from the side edge 133 and guides the stack of cups 54 toward the side opening 132 as the stack of cups 54 is side-loaded.

Figure 20:
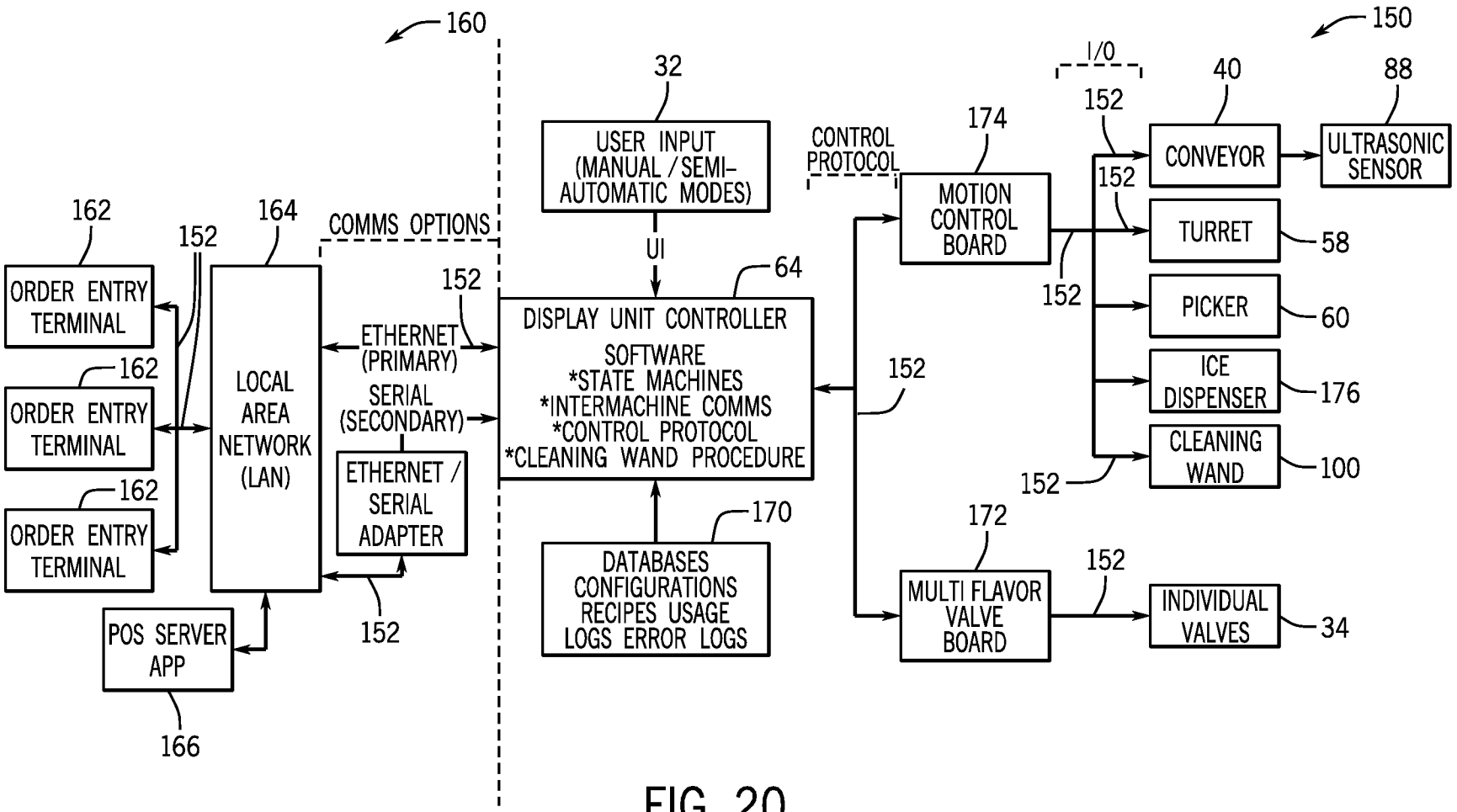
FIG. 20 depicts a schematic diagram of an example control system.

FIG. 20 depicts an example schematic diagram of a control system 150 for the beverage dispensing machine 10. In the example shown, the control system 150 includes the computer controller 64, which is programmable and includes a processor and a memory. The computer controller 64 can be located anywhere in the control system 150 and/or located remote from the control system 150 and can communicate with various components of the beverage dispensing machine 10 via a networks, peripheral interfaces, and wired and/or wireless links. Although FIG. 20 shows one computer controller 64, the control system 150 can include more than one computer controller. Portions of the method disclosed herein below can be carried out by a single computer controller or by several separate computer controller.

In some examples, the computer controller 64 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a dispensing method, which directs the processing system to operate as described herein below in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "computer controller" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A computer controller may include memory (shared, dedicated, or group) that stores code executed by the processing system. The term "code" may include software, firmware, and/or microcode, and may refer to programs, routines, functions, classes, and/or objects. The term "shared" means that some or all code from multiple computer controllers may be executed using a single (shared) processor. In addition, some or all code from multiple computer controllers may be stored by a single (shared) memory. The term "group" means that some or all code from a single computer controller may be executed using a group of processors. In addition, some or all code from a single computer controller may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The computer controller communicates with one or more components of the control system via the I/O interfaces and a communication link, which can be a wired or wireless link. The computer controller is capable of monitoring and controlling one or more operational characteristics of the control system and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the computer controller and each of the peripheral devices noted herein, although not every connection is shown in the drawing for purposes of clarity.

The computer controller functionally converts input signals, such as but not limited to order signals, inputs received via the user interface 32, or information from sensors, to output signals, such as but not limited component control signals, according to the computer executable instructions. Each of the input signals can be split into more than one branch, depending on how many functions are to be carried out and/or how many actuators are to be controlled with each of the input signals. The input signals may be fed to several software modules within the computer controller through branch signals. The exact signals input into the software modules can be taken directly from the corresponding control input device or sensor, or could be pre-processed in some way, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal The provided description of the computer controller is conceptual and should be interpreted generally, as those skilled in the art will recognize many ways to implement such a computer controller. These include implementation using a digital microprocessor that receives input signals or branch signals and performs a calculation using the input signals to produce the corresponding output signals or actuator control signals. Also, analog computers may be used, which comprise circuit elements arranged to produce the desired outputs. Furthermore, look-up tables containing predetermined or calibrated data points may be stored in any fashion to provide the desired output corresponding to a given input signal.

The control system 150 is in communication, via wired or wireless communication links 152, with a point-of-sale (POS) order system 160 that receives beverage order signals from order entry terminals or stations 162 into which crew members or operators input food and beverage orders. The order entry terminals 162 can be located in-store at a customer countertop or at drive-thru windows, and the computer controller 64 can simultaneously receive orders from multiple order entry terminals 162. The order entry terminals 162 transmit order signals corresponding to the food and beverage orders through a local area network (LAN) 164 to the computer controller 64. An order controller and/or processing module 166 is connected to the local area network 164 and can be configured to process the order signals.

The user interface 32 is in communication with the computer controller 64. In the example depicted in FIG. 1, the user interface 32 includes a pair of touch-screens that receive inputs from an operator stationed at the beverage dispensing machine 10. A combination processing system and storage system 170 is in communication with the computer controller 64 and has various software programs, data sets, data bases, operating configuration, recipes, usage logs, error logs, and the like stored thereon. The computer controller 64 can further include a separate processing system and/or additional software storage system with additional information stored thereon such as state machines, intermachine communications, control protocols, cleaning clean-in-place system, procedures, and the like.

Figure 6:
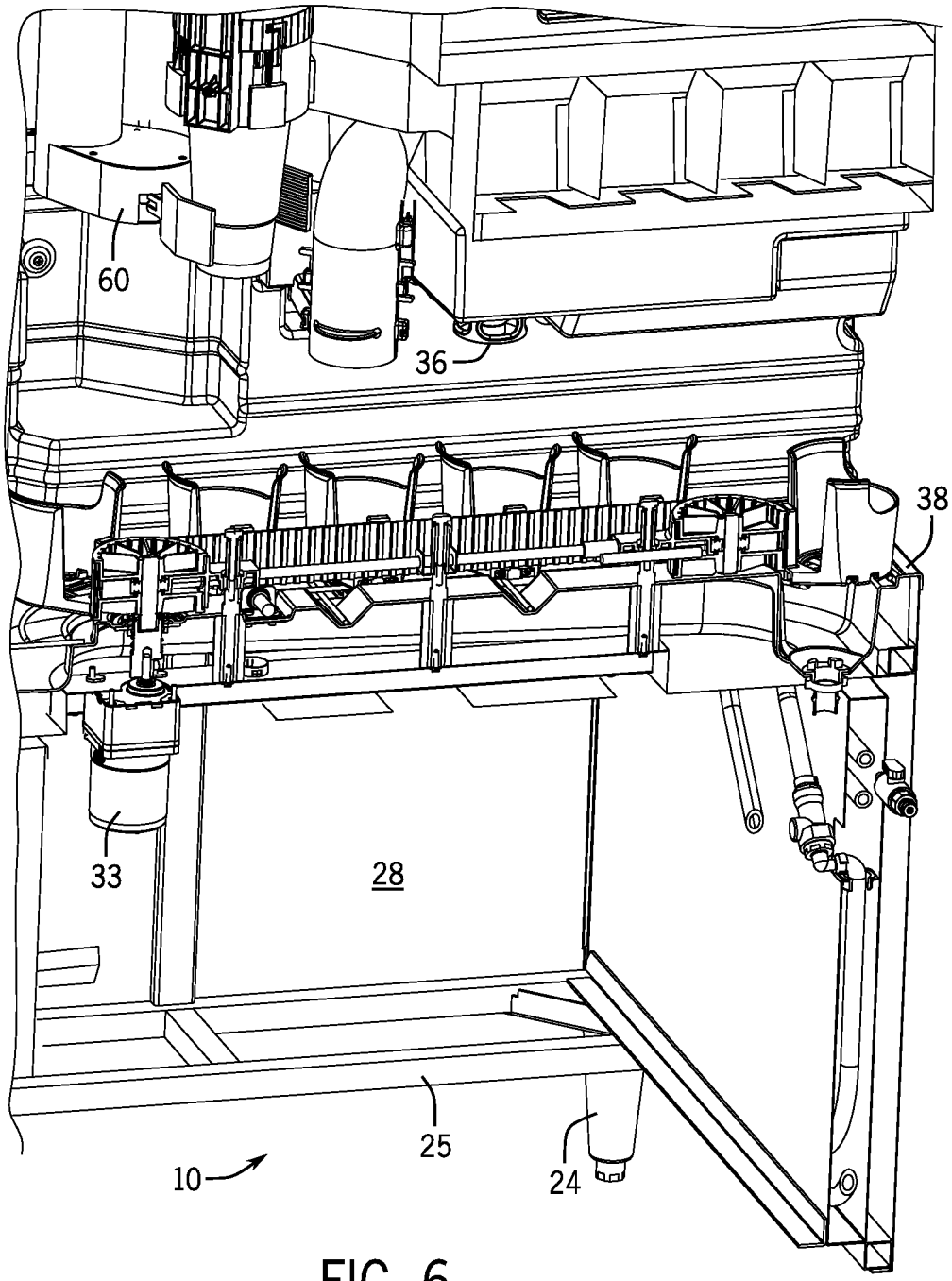
FIG. 6 is a sectional view of the beverage dispensing machine shown in FIG. 1 and showing a conveyor for conveying a plurality of cup holders around a track.
Figure 7:
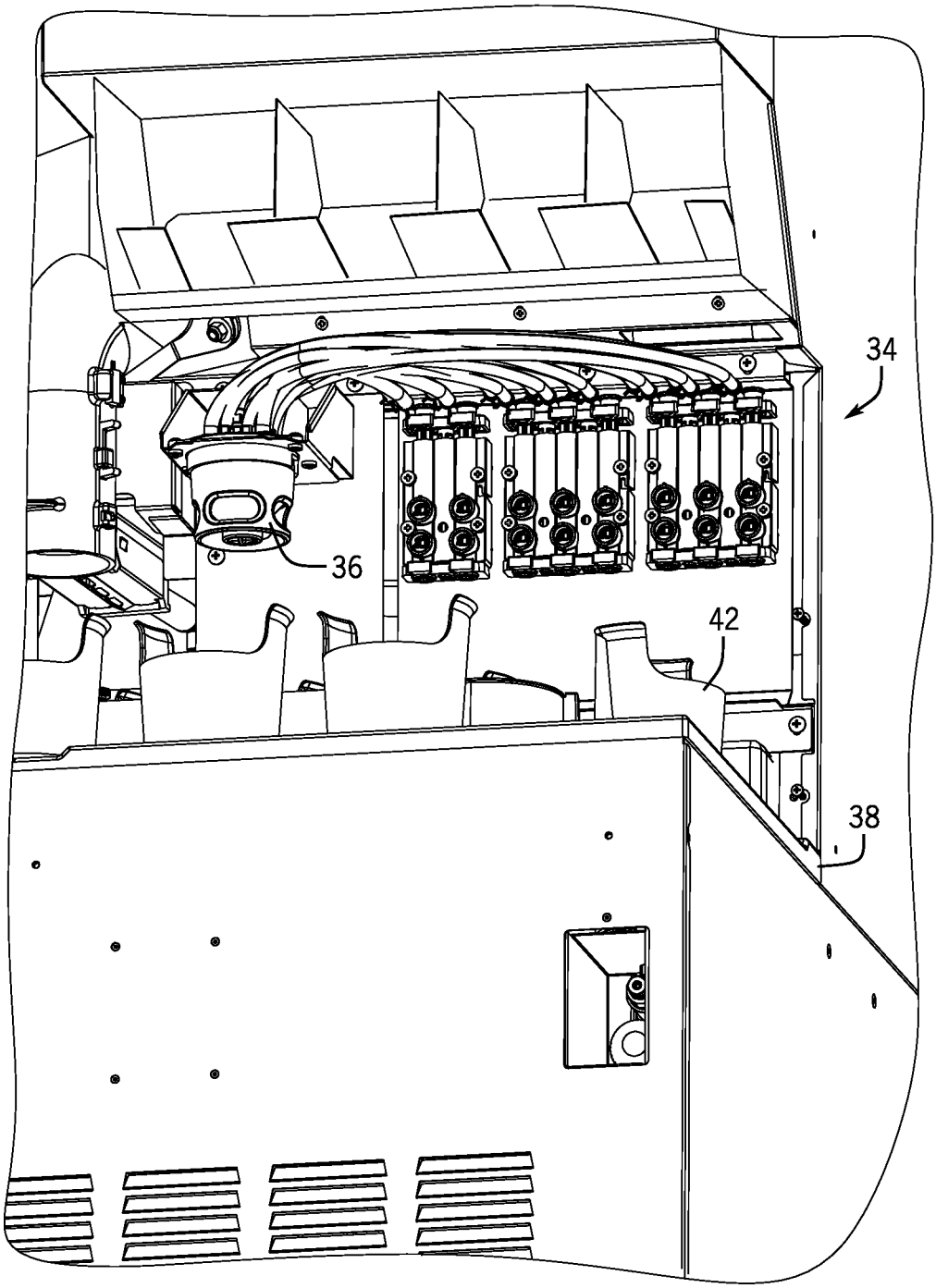
FIG. 7 is a front right side perspective view looking up at dispensing valves on the beverage dispensing machine shown in FIG. 1.

The computer controller 64 is in communication with a multiflavor valve module 172 that controls the dispensing valves 34 such that the flow of beverage or beverage components dispensed through the common dispensing nozzle 36 (FIG. 1) creates or forms the ordered beverage. The computer controller 64 is also in communication with a motion control module 174 that is configured to receive control signals from the computer controller 64, send operational control signals to components of the beverage dispensing machine 10, and receive signals from components of the beverage dispensing machine 10. For example, the motion control module 174 can send an operational control signal to the conveyor 40 to thereby cause the conveyor 40 to move the cup holders 42 (FIG. 6). In another instance, the motion control module 174 can receive signals from the ultrasonic sensor 88 that correspond to the presence of a cup in a cup holder 42. The motion control module 174 is also in communication with cup tower or turret motor 58, the actuator that actuates the cup grabber 60, an ice dispensing valve 176 that controls the flow of the ice into a cup 54, and the cleaning clean-in-place system 100.

Figure 21:
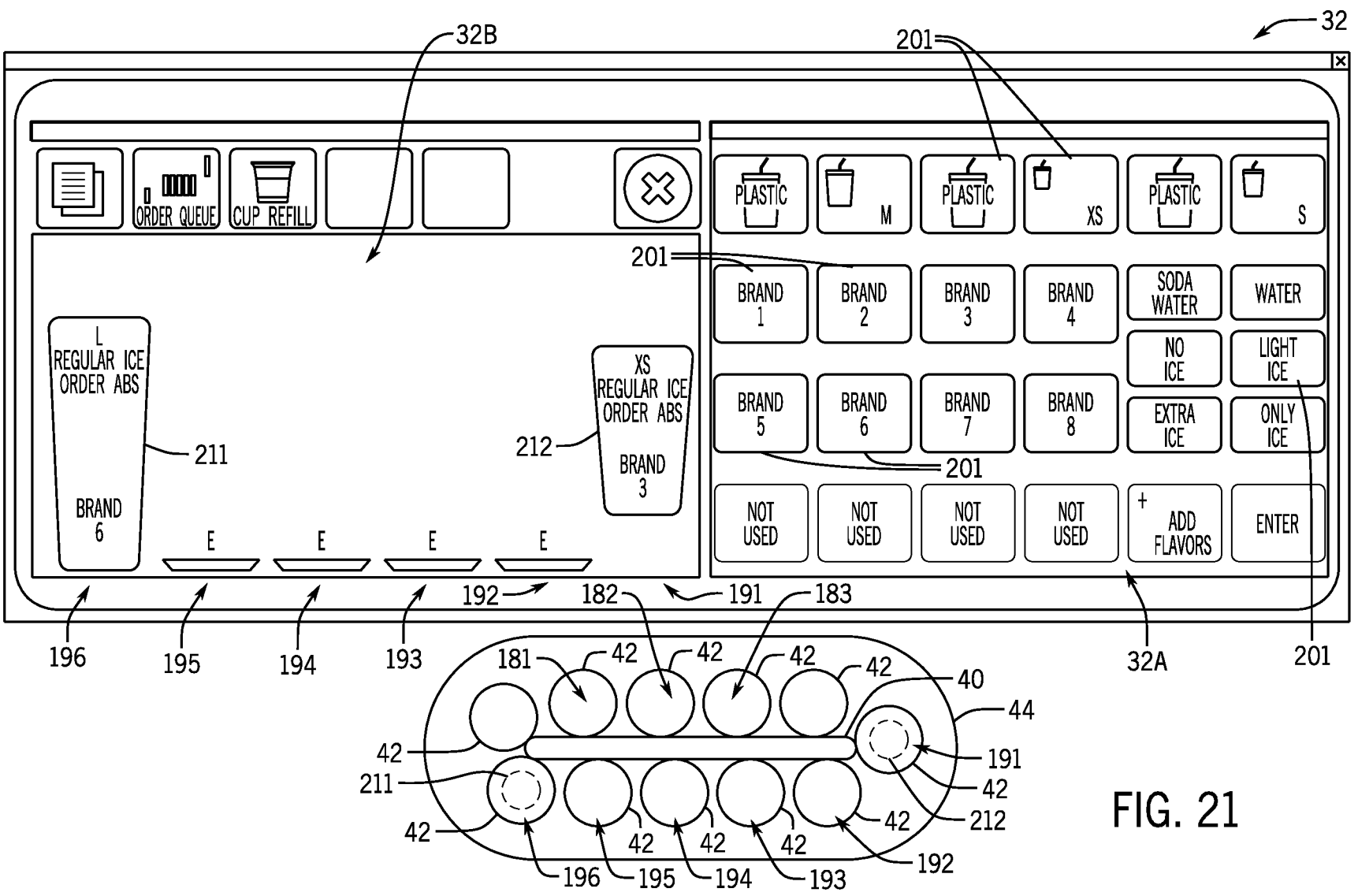
FIGS. 21-23 depict an example operational sequence of the beverage dispensing machine with a front view of a user interface and a schematic view of the conveyor and the cup holders.
Figure 22:
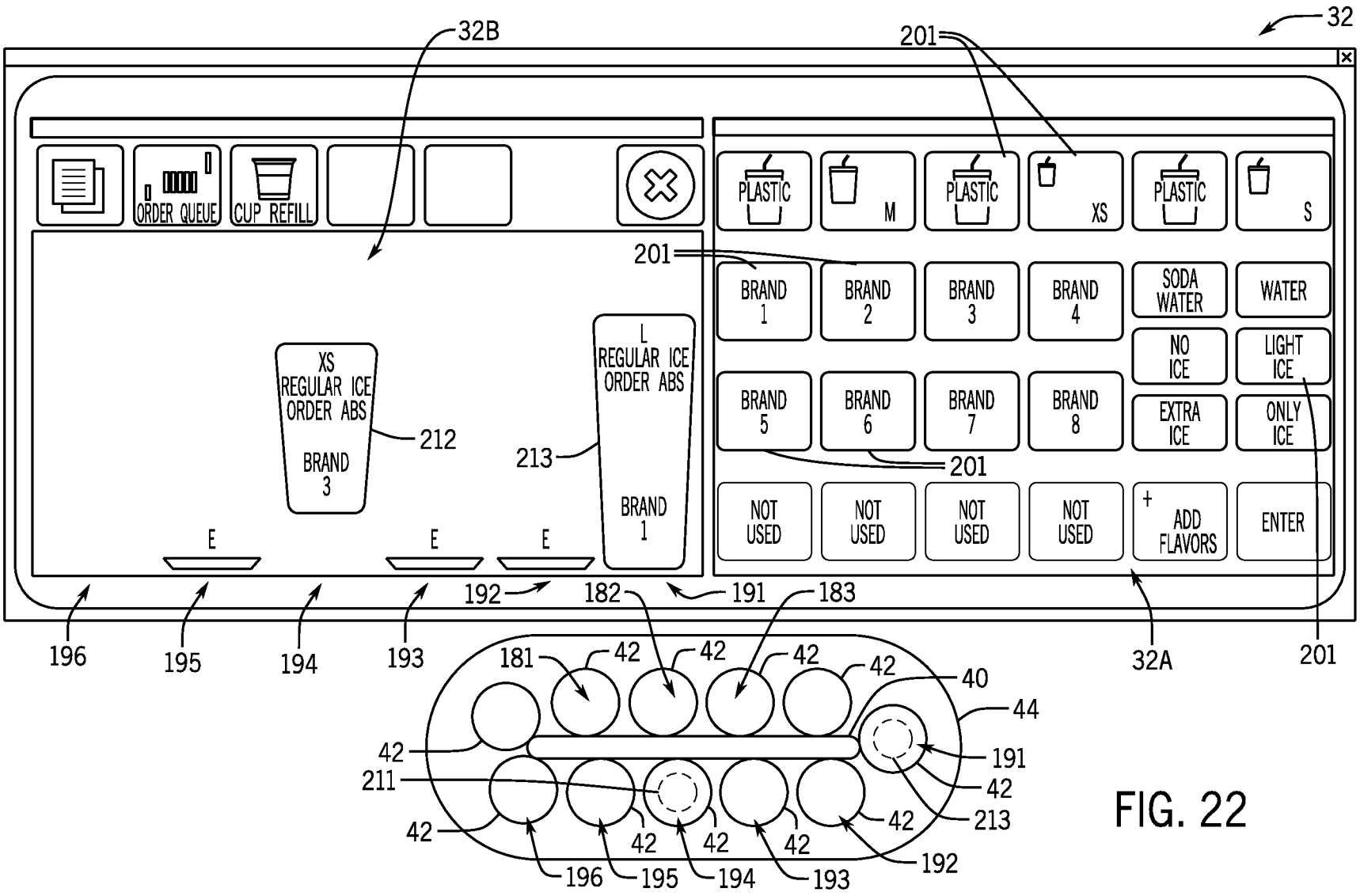
Figure 23:
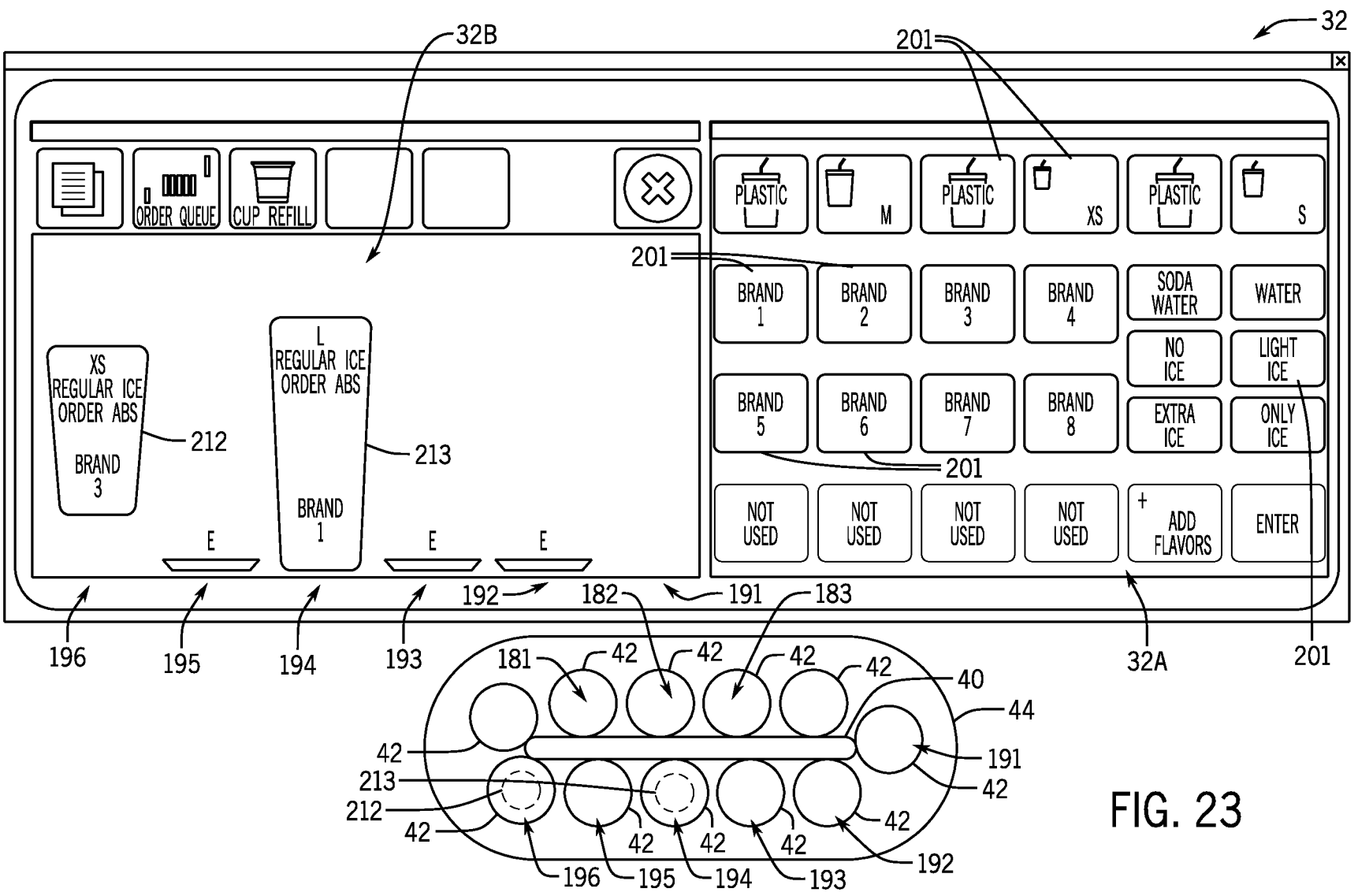

Referring to FIGS. 21-23, an example operational sequence of the beverage dispensing machine 10 is depicted. During operation, the operator or crew member engages with the order entry terminal 162 (FIG. 20) to enter a food and beverage order. For example, the order may consist of a large cola, a small white soda, and three cheese burgers. The order entry terminals 162 relay order signals corresponding to the order through the POS order system 160 to the computer controller 64. Based on the order signals received, the computer controller 64, along with the multi-flavor valve module 172 and motion control module 174, controls the components of the beverage dispensing machine 10 to form the beverages ordered by the customer.

Orders signals related to the ordered beverages are received by the computer controller 64 and placed into a queue or order list as they are received. The beverages are then formed by the beverage dispensing machine 10 in the order they are received. That is, the beverage received first is formed, followed by the beverage received second, the beverage received third, and so on. That is, beverages are formed in the order in which the order signals are received by the computer controller 64. In other examples, order signals received from certain order entry terminals 162, such as quick-delivery terminals or drive thru terminals, are given priority over earlier received order signals and accordingly the beverages related to the order signals from these order entry terminals 162 are given "priority" and made before beverages related to order signals from other order entry terminals 162.

The order signals received by the computer controller 64 are assigned origination codes that are displayed on the user interface 32 such that the beverages formed can be easily matched to the customer's food and beverage order. For example, order signals received from the order entry terminals 162 are assigned origination codes that correspond to the order number, such as Order #1235, Order #1236, and Order #1239. It is further contemplated that the origination codes can include additional information to assist the crew members with correctly matching the beverage formed by the beverage dispensing machine 10 to the food and beverage order (e.g. the origination code may include an order entry terminal value that corresponds to the specific order entry terminal 162 at which the order was entered).

To form a beverage, the cup tower 50 is rotated such that a stack of cups 54 with the correctly sized cup 54 for the beverage is directly vertically above the cup grabber 60 (see FIG. 1 for components not shown in FIGS. 21-23). The cup grabber 60 then grabs the cup 54 and drops the cup 54 into a cup holder 42 vertically directly below the cup grabber 60 (see first beverage forming position 181). The conveyor 40 then moves the cup 54 to a second beverage forming position 182 where the cup 54 is filled with ice and a third beverage forming position 183 where the cup 54 is filled with the beverage. The cup 54 is then conveyed to and through a series of beverage staging positions (see 191-196) that are positioned toward or along the front 20 of the beverage dispensing machine 10 such that the operator or crew member can easily remove the cup 54.

The user interface 32 includes a pair of touch-screens, namely a first touch-screen 32A and a second touch-screen 32B (note that FIGS. 21-23 depict the user interface 32 and the conveyor 40 with cup holders 42 immediately adjacent each other for clarity purposes). The first touch-screen 32A displays a beverage selection screen that allows the operator to manually enter a beverage order into the beverage dispensing machine 10 without entering the beverage order into a remote order entry terminal 162. This feature is advantageous when a previous beverage order was incorrectly entered via the remote order entry terminal 162 or if the beverage is accidentally spilled. In certain examples, the beverage order entered via the first touch-screen 32A is given priority over the beverages listed in the beverage queue such that the beverage inputted via the first touch-screen 32A is formed before other beverages in the beverage queue. In other examples, the beverage order entered via the first touch-screen 32A is placed at the bottom of the beverage queue and is formed after the beverages already in the beverage queue. The first touch-screen 32A includes a plurality of beverage options 201, such as brands, levels of ice, additives (e.g. flavor shots), and the like, which are selected to form the beverage. The layout of the beverage options 201 can vary and may change based on the operational mode of the computer controller 64, such as auto mode in which the computer controller 64 automatically forms beverages as they are received from the order entry terminals 162 and semi-auto mode in which the computer controller 64 forms beverages based on the order signals or inputs from the order entry terminals 162 and the first-touch screen 32A.

The second touch-screen 32B displays a graphical representation of the physical location of the beverages and cups 54 at each of the beverage staging positions (see 191-196). That is, the second touch-screen 32B displays an image of the beverage, including size, type, and/or order origination code, that corresponds to the physical location of the beverage in the conveyor 40. Specifically, the second touch-screen 32B displays images for real-time tracking of the beverages in the cup holders 42 of the conveyor 40. FIG. 21 depicts the a first beverage 211 (a large "L" cup of "Brand 6" beverage) in beverage staging position 196 and a second beverage 212 (an extra small "Xs" cup of "Brand 3" beverage) in beverage staging position 191. The first beverage 211 is removed by the operator such that the ultrasonic sensor 88 does not sense a cup 54 in beverage staging position 196 and accordingly, the conveyor 40 moves the cup holders 42 and the second beverage 212 to a different beverage staging position (see FIG. 22).

FIG. 22 depicts the second beverage 212 moved into beverage staging position 194 and a third beverage 213 (a large "L" cup of "Brand 1" beverage) in beverage staging position 191. The computer controller 64 is configured to display a graphical animation of the beverages 212, 213 moving to the different beverage staging positions 191-196 represented on the second touch-screen 32B as they are physically moved by the conveyor 40. FIG. 23 depicts the second beverage 212 moved to beverage staging position 196. The ultrasonic sensor 88 senses the second beverage 212 in beverage staging position 196 and therefore sends a signal to the computer controller 64 such that the conveyor 40 does not move the beverages 212, 213 further and thereby prevents the second beverage 212 from being moved to the first beverage forming position 181.

The touch-screen 32A, 32B can display other information to the operator based on the operational mode of the computer controller 64. For example, the touch-screen 32A, 32B may display the number and types of beverages that have been created by the beverage dispensing machine 10, cleaning steps to be followed by the operator to properly clean the beverage dispensing machine 10, and the like. In certain examples, if one of the touch-screens 32A, 32B fails the remaining operational touch-screen can function in a secondary mode such that the operation of the beverage dispensing machine 10 does not fully stop due to the failure of one of the touch-screens 32A, 32B.

Figure 24:
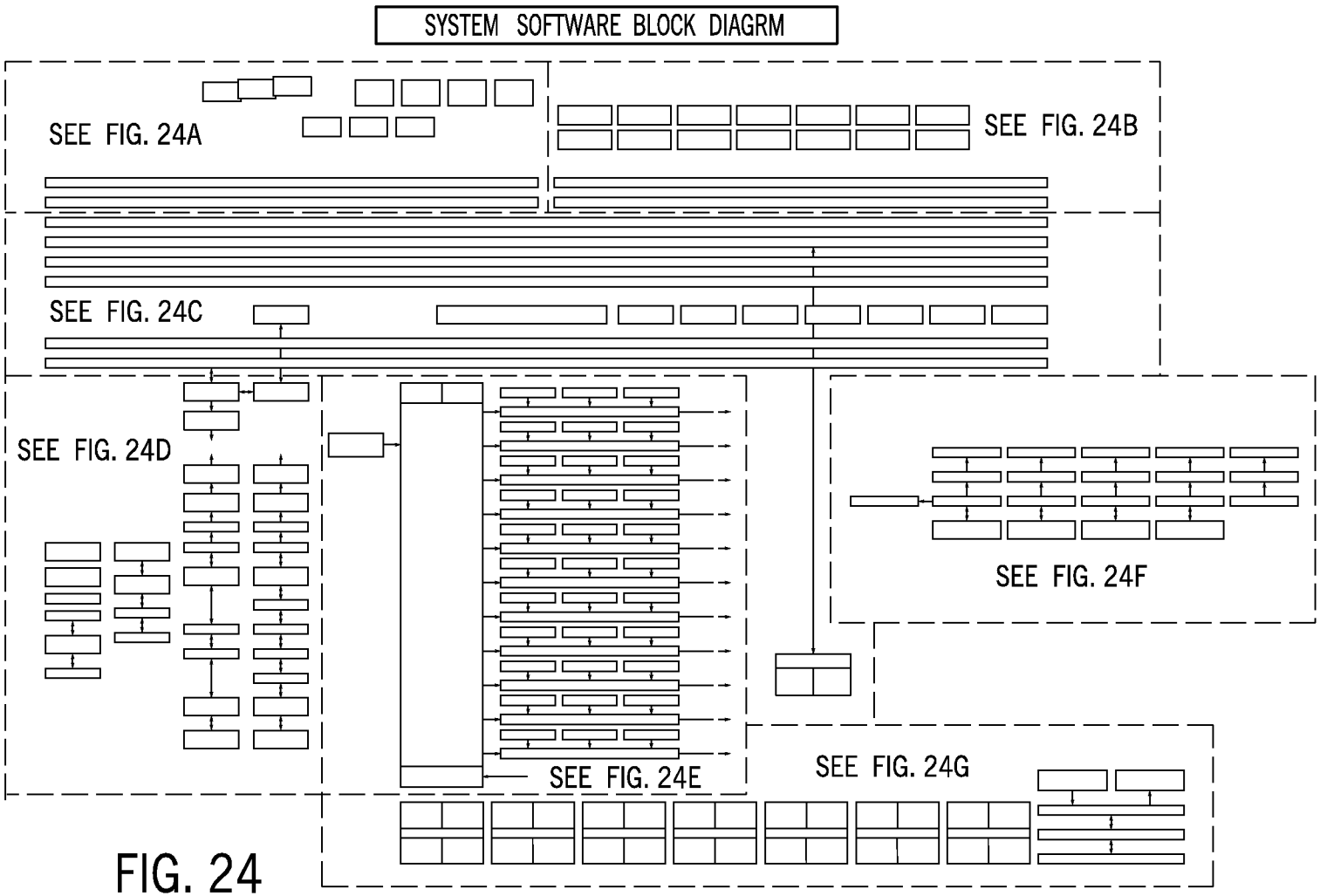
FIG. 24 is an example system software block diagram according to the present disclosure.
Figure 24A:
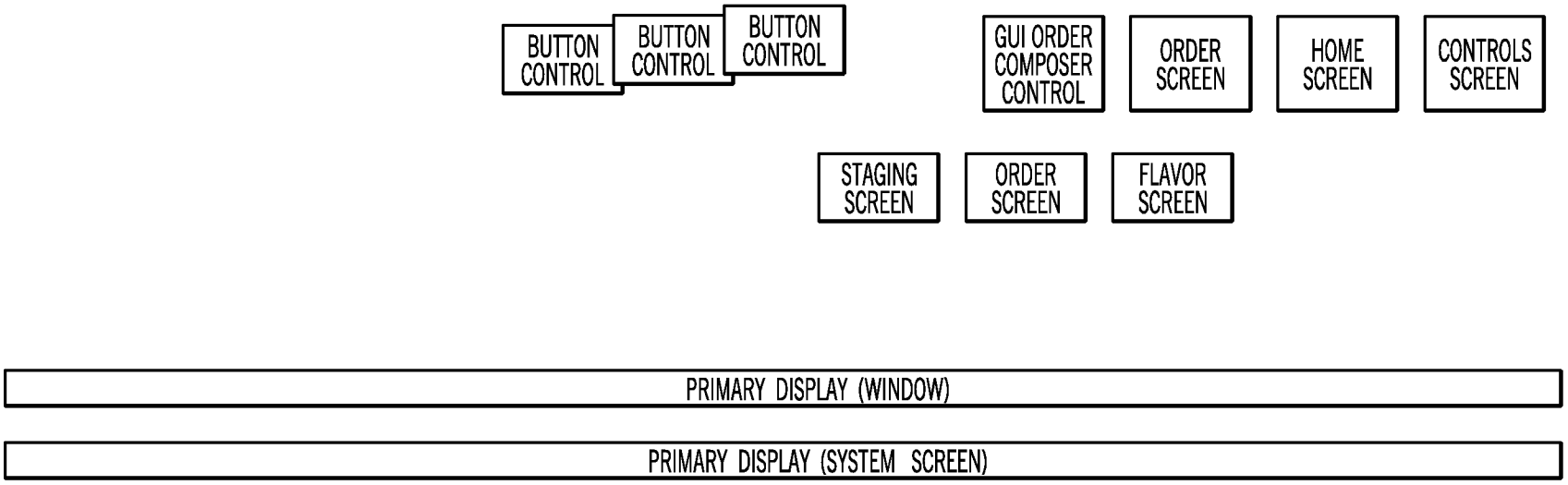
FIGS. 24A-24G depict the details of the system software block diagram of FIG. 24.
Figure 24B:
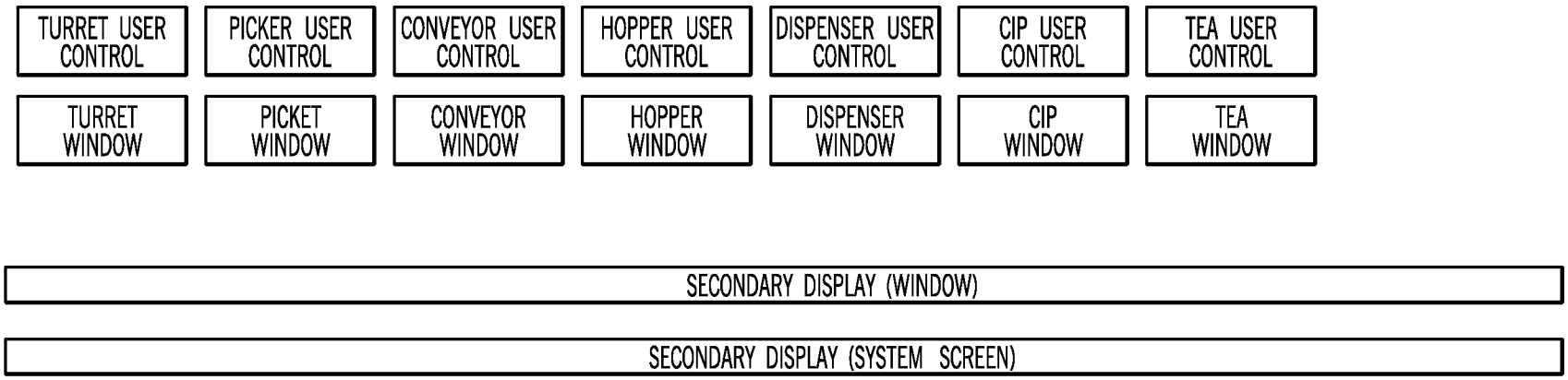
Figure 24C:
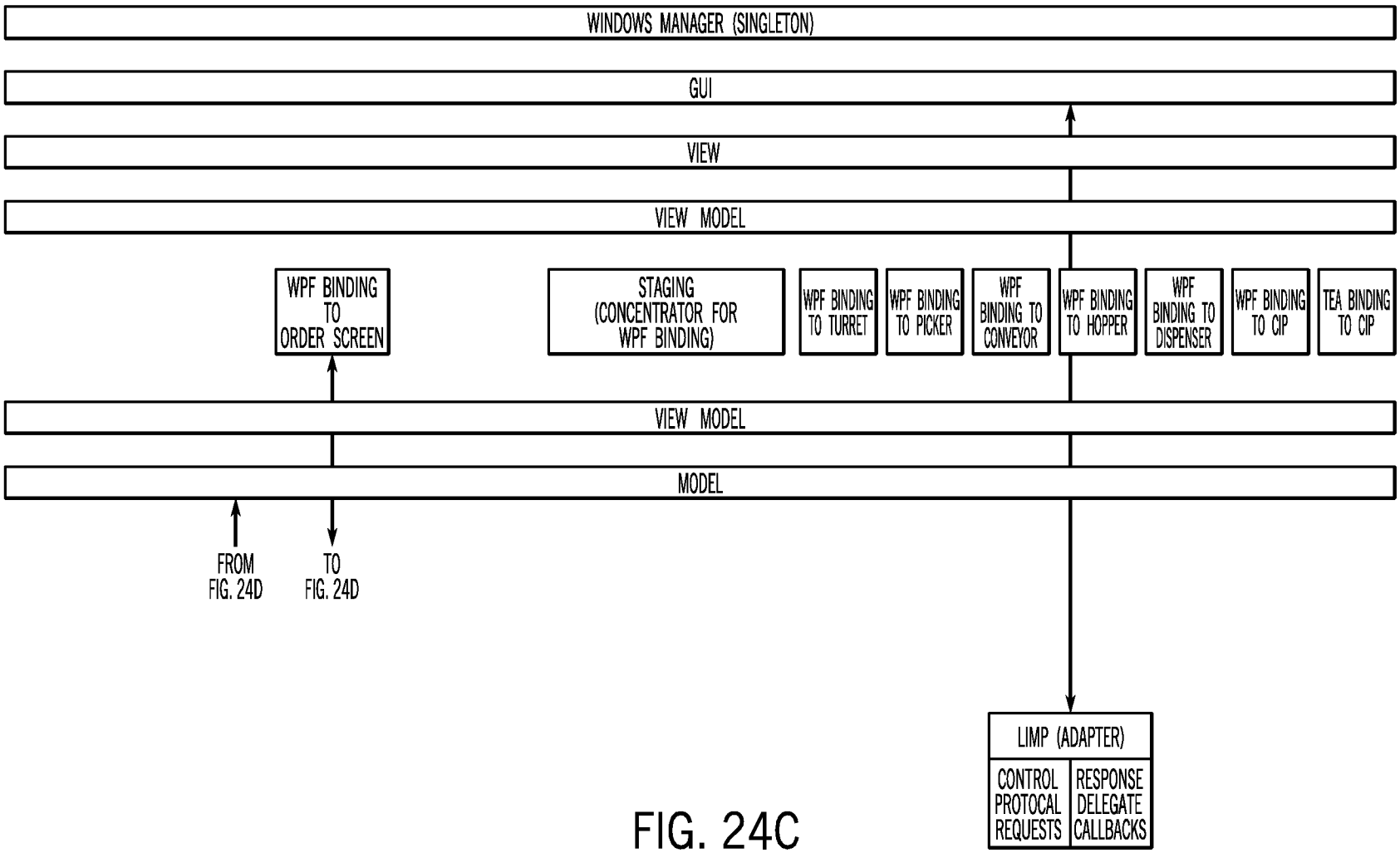
Figure 24D:
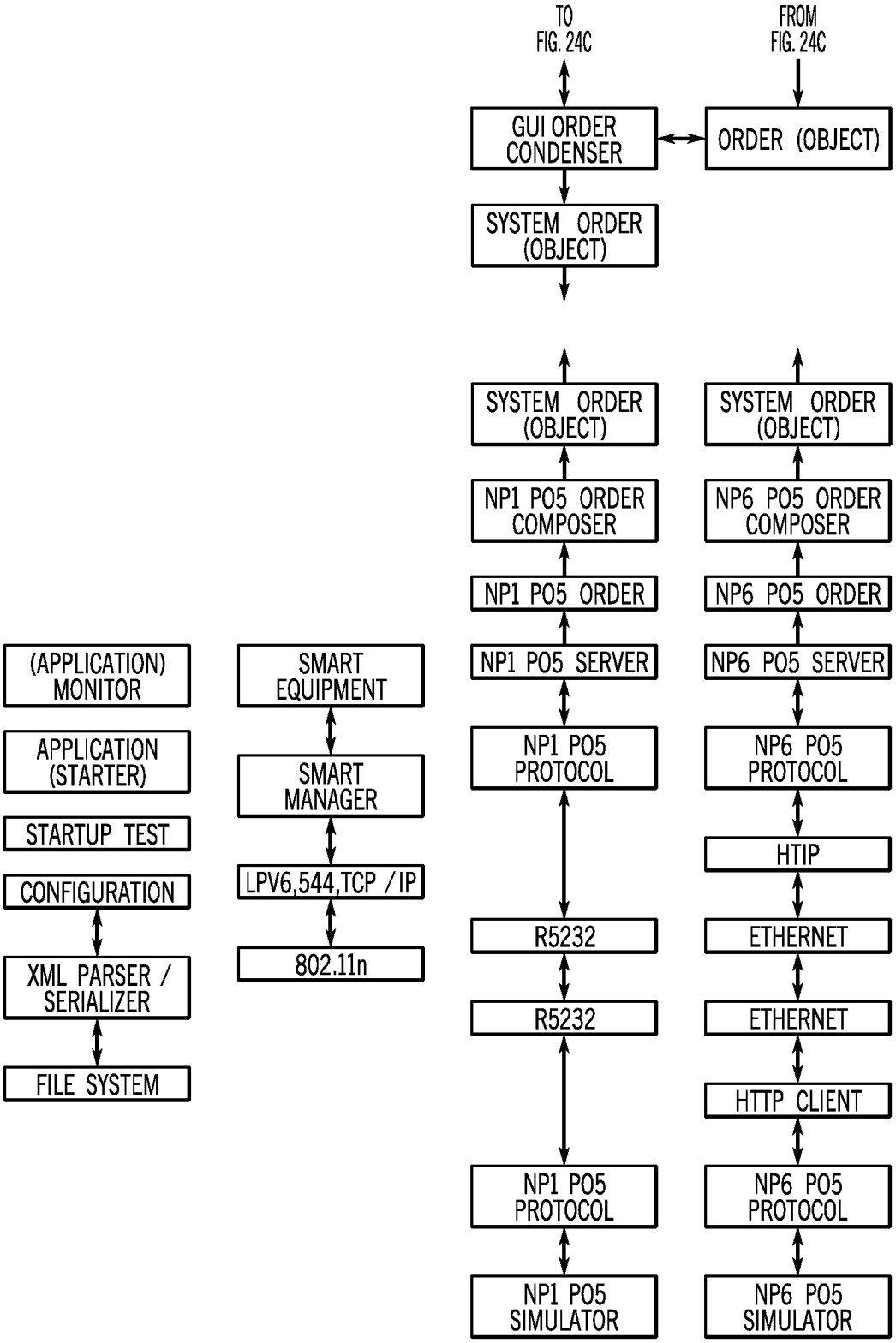
Figure 24E:
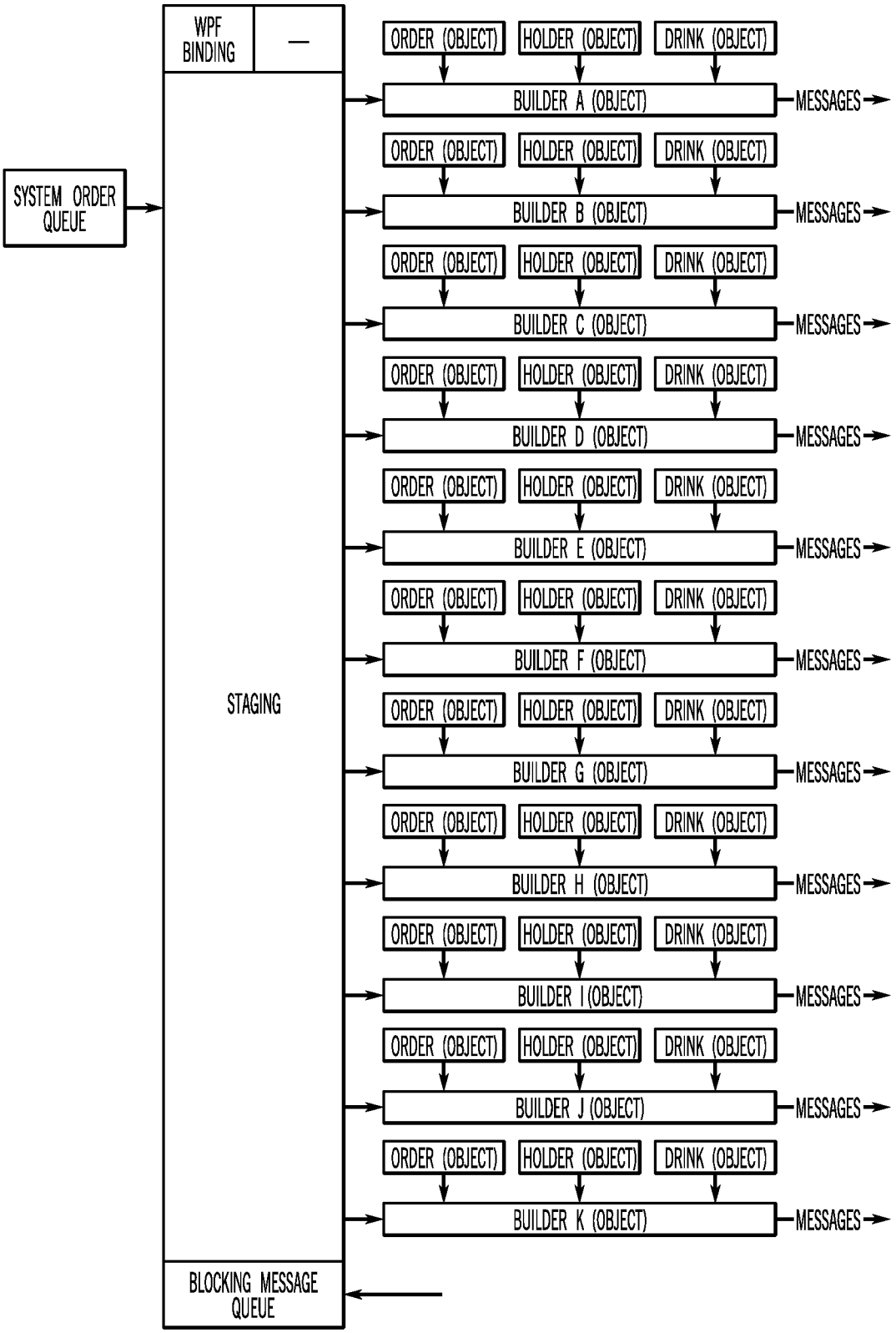
Figure 24F:
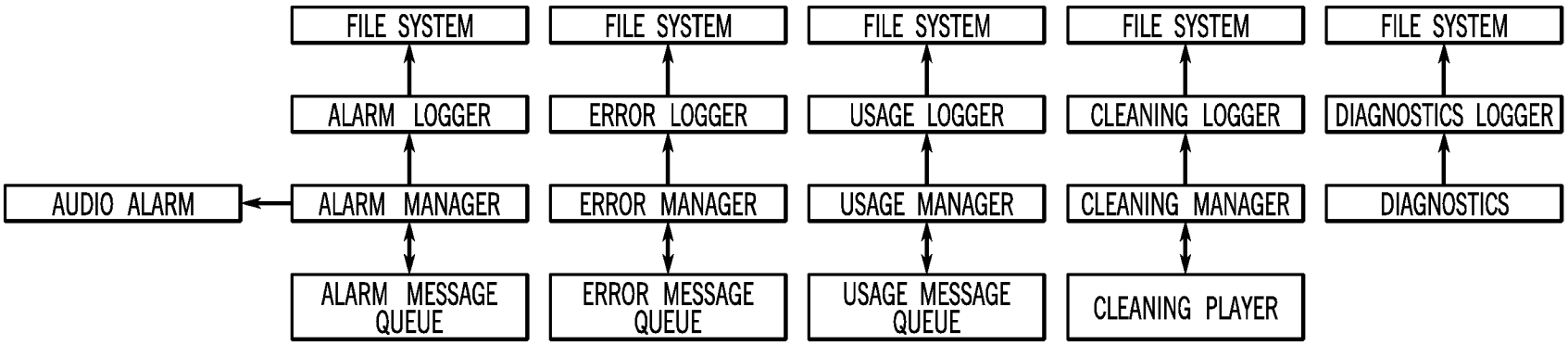
Figure 24G:
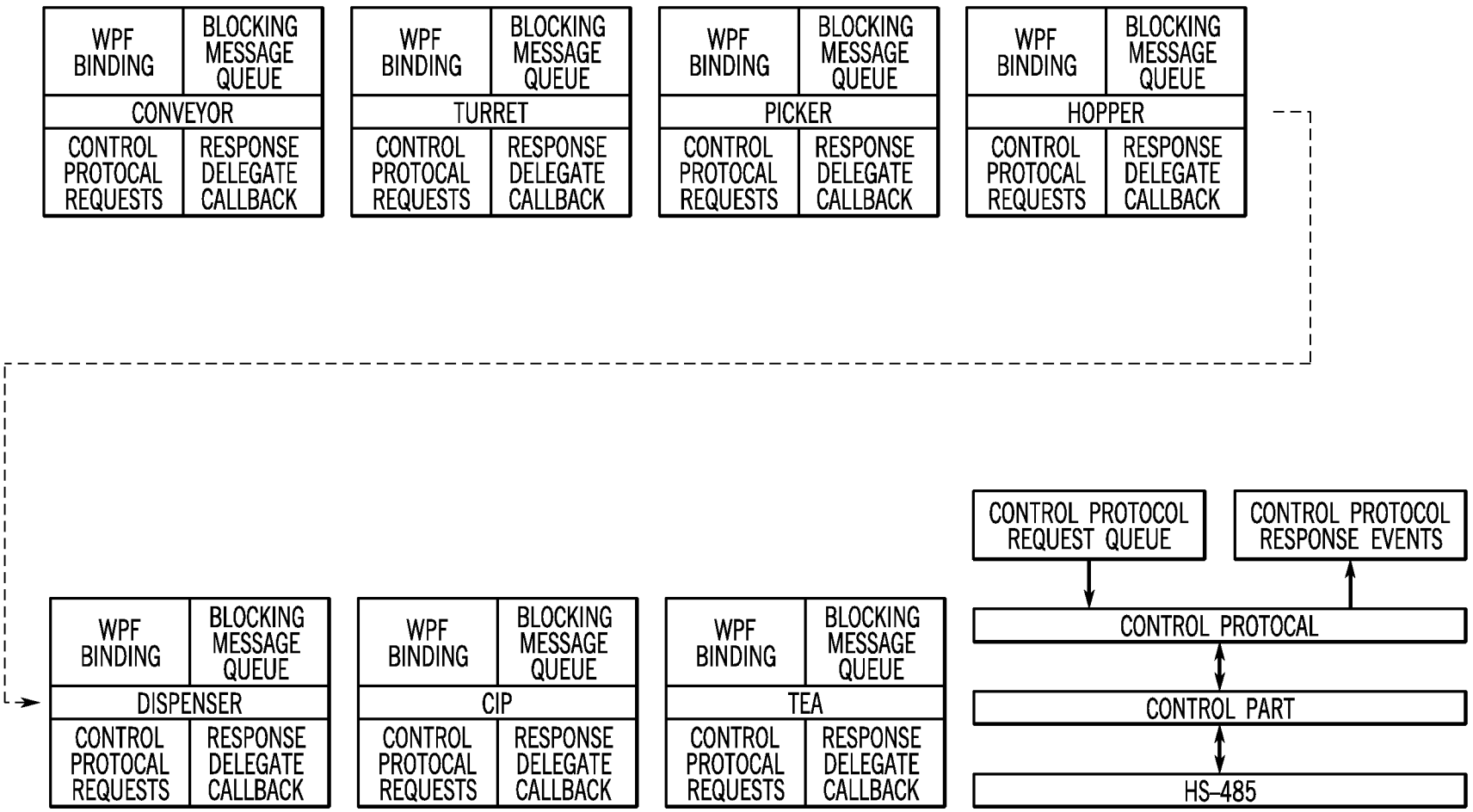

FIG. 24 is an example system software block diagram according to the present disclosure, and FIGS. 24A-24G depict the details of the system software block diagram of FIG. 24. The software is fully modularized, and each specific device subsystem has a dedicated software module assigned to it. The central software module is the staging module which handles the progress of drink building modules called "Builders" through their drink building process including dispensing of cup, ice, and beverage in dedicated locations. Each built beverage or drink is assigned its own Builder module which serves the beverage according to its assigned drink order. When the drink building process is finished and the beverage is moved past the last staging location protected by the cup presence sensor then the assigned Builder module is fully reinitialized to receive a pending drink order. In addition to the core functionality of the central software module, the software contains additional modules dedicated to drink order reception and queuing and modules dedicated to device configuration, maintenance, diagnostics, error detection and persistence, usage data maintenance, and application startup and termination management.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses and methods described herein may be used alone or in combination with other apparatuses and methods. Various equivalents, alternatives and modifications are possible within the scope of the appended claims.

The invention claimed is:

1. A beverage dispensing machine comprising:

a conveyor that carries a plurality of cup holders around a track having a front side oriented towards a front of the beverage dispensing machine and a back side oriented towards a back of the beverage machine, wherein the front side provides a plurality of beverage staging positions that are accessible by an operator to manually remove cups from the plurality of cup holders;

a cup tower configured to hold a plurality of stacks of cups and to place cups from the plurality of stacks of cups into the plurality of cup holders;

a dispensing nozzle configured to dispense a beverage into the cups in the plurality of cup holders;

a plurality of dispensing valves configured to control flow of the beverage to the dispensing nozzle;

a computer controller configured to control movement of the conveyor, control movement of a cup grabber into and between the lowered position and raised position, and control the plurality of dispensing valves to dispense the beverage via the dispensing nozzle; and an ultrasonic sensor that senses whether a cup is present in a respective cup holder of the plurality of cup holders when the respective cup holder is adjacent the ultrasonic sensor, and wherein the computer controller is configured to control the conveyor based in part upon an output from the ultrasonic sensor, wherein the ultrasonic sensor senses whether a cup is present in the respective cup holder through a window in a sidewall of the cup holder.

2. The beverage dispensing machine according to claim 1, further comprising a user interface configured to receive manual inputs from the operator and communicate the manual inputs to the computer controller, which in turn is configured to control the movement of the conveyor, the movement of the cup grabber, and the plurality of dispensing valves based on the manual inputs; wherein the user interface comprises a touchscreen providing an animated graphical representation of the plurality of beverage staging positions and the cups in the plurality of cup holders as the computer controller controls movement of the conveyor and as the operator manually removes the cups from the plurality of cup holders.

3. The beverage dispensing machine according to claim 1, wherein the computer controller comprises a motion control module configured to send operational control signals to the conveyor to thereby cause the conveyor to move the plurality of cup holders and to receive signals from the ultrasonic sensor corresponding to presence of a cup in one of the plurality of cup holders.

4. The beverage dispensing machine according to claim 1, wherein each cup holder in the plurality of cup holders comprises a base, a sidewall extending upwardly from the base, and the window is a front window formed in the sidewall and having an open top, wherein the front window is oriented away from a center of the track, the front window oriented and sized to facilitate manual grasping and removal of a cup from the cup holder when the cup holder is located on the front side of the track.

5. The beverage dispensing machine according to claim 4, wherein each cup holder further comprises a rear window oriented towards a center of the track and having an open top, wherein the rear window facilitates manual access to a connection point between the cup holder and the conveyor.

6. The beverage dispensing machine according to claim 5, wherein the rear window is located directly opposite the front window so that the sidewall forms a pair of side flanges on opposite sides of the cup holder.

7. The beverage dispensing machine according to claim 6, further wherein the conveyor comprises a conveyor belt that extends around the track, and wherein each cup holder is connected to the conveyor belt by a dovetail connection.

8. The beverage dispensing machine according to 7, wherein the dovetail connection comprises a vertical dovetail channel and a vertical dovetail tab that is received in the vertical dovetail channel by manually sliding one of the vertical dovetail channel and vertical dovetail tab with respect to the other of the vertical dovetail channel and vertical dovetail tab.

9. The beverage dispensing machine according to claim 1, wherein the ultrasonic sensor is spaced apart from the conveyor so that a gap exists between the sensor and the track and wherein the ultrasonic sensor is configured to repeatedly emit ultrasonic waves to sense whether a cup is present in one of the plurality of cup holders.

10. The beverage dispensing machine according to claim 9, wherein the ultrasonic sensor is configured to repeatedly sense whether a cup is present in one of the plurality of cup holders to rule out a false reading caused by an obstruction located in the gap between the sensor and the track.

11. The beverage dispensing machine according to claim 1, wherein the computer controller is configured to receive order signals related to ordered beverages and place the order signals in a queue in order of receipt by the computer controller, and wherein thereafter the computer controller is configured to control the plurality of dispensing valves to dispense beverages according to the order signals and in order according to the queue.

12. The beverage dispensing machine according to claim 11, wherein the computer controller is configured to receive a priority order signals and place the priority order signal ahead of the plurality of order signals in the queue for priority dispensing.

13. The beverage dispensing machine according to claim 11, wherein the computer controller is configured to assign origination codes to the order signals and display the origination codes on a user interface.

14. The beverage dispensing machine according to claim 1, wherein the back side of the conveyor comprises a plurality of forming positions in which the beverage and ice are dispensed to the cups.

* * * * *